US011145316B2

(12) United States Patent
Nagisetty et al.

(10) Patent No.: US 11,145,316 B2
(45) Date of Patent: Oct. 12, 2021

(54) ENCODER AND ENCODING METHOD FOR SELECTING CODING MODE FOR AUDIO CHANNELS BASED ON INTERCHANNEL CORRELATION

(71) Applicant: Panasonic Intellectual Property Corporation of America, Torrance, CA (US)

(72) Inventors: Srikanth Nagisetty, Singapore (SG); Sua Hong Neo, Singapore (SG); Hiroyuki Ehara, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 99 days.

(21) Appl. No.: 16/612,902

(22) PCT Filed: May 9, 2018

(86) PCT No.: PCT/JP2018/017894
§ 371 (c)(1),
(2) Date: Nov. 12, 2019

(87) PCT Pub. No.: WO2018/221138
PCT Pub. Date: Dec. 6, 2018

(65) Prior Publication Data

US 2020/0168232 A1 May 28, 2020

(30) Foreign Application Priority Data

Jun. 1, 2017 (JP) ..... JP2017-109135

(51) Int. Cl.
*G10L 19/008* (2013.01)
*G10L 19/005* (2013.01)
(Continued)

(52) U.S. Cl.
CPC ..... *G10L 19/008* (2013.01); *G10L 19/00* (2013.01); *G10L 19/005* (2013.01); *G10L 19/24* (2013.01)

(58) Field of Classification Search
CPC ..... G10L 19/008
See application file for complete search history.

(56) References Cited

U.S. PATENT DOCUMENTS

2003/0236583 A1* 12/2003 Baumgarte ..... H04S 1/007 700/94
2004/0230423 A1* 11/2004 Chrysafis ..... G10L 19/008 704/216

(Continued)

OTHER PUBLICATIONS

International Search Report of PCT application No. PCT/JP2018/017894 dated Jul. 17, 2018.

(Continued)

*Primary Examiner* — Jialong He
(74) *Attorney, Agent, or Firm* — Greenblum & Bernstein, P.L.C

(57) ABSTRACT

An inter-channel correlation calculation unit calculates an inter-channel correlation between a left channel and a right channel by using a left channel signal and a right channel signal that constitute a stereo signal. A DMA stereo encoding unit and a DM stereo encoding unit encode the left channel signal and the right channel signal by using a common coding mode when the inter-channel correlation is greater than a threshold value, and individually encode the left channel signal and the right channel signal by using a coding mode determined for each of the left channel signal and the right channel signal when the inter-channel correlation is less than or equal to the threshold value.

14 Claims, 16 Drawing Sheets

(51) Int. Cl.
*G10L 19/24* (2013.01)
*G10L 19/00* (2013.01)

(56) References Cited

U.S. PATENT DOCUMENTS

2009/0210236 A1* 8/2009 Moon ..... G10L 19/008
704/500
2010/0153119 A1* 6/2010 Lee ..... G10L 19/008
704/500
2013/0223633 A1* 8/2013 Oshikiri ..... G10L 19/22
381/21
2014/0098963 A1* 4/2014 Lang ..... H04S 3/008
381/23
2015/0269948 A1* 9/2015 Purnhagen ..... H04S 5/02
704/500
2016/0269846 A1* 9/2016 Par ..... G10L 19/008

OTHER PUBLICATIONS

3GPP TS 26.445 V13.4.0, "3rd Generation Partnership Project; Technical Specification Group Services and System Aspects; Codec for Enhanced Voice Services (EVS); Detailed Algorithmic Description (Release 13)", Dec. 2016.
3GPP TS 26.445 V14.0.0, "3rd Generation Partnership Project; Technical Specification Group Services and System Aspects; Codec for Enhanced Voice services (EVS); Detailed Algorithmic Description (Release 14)", Mar. 2017, pp. 1-24.
J. D. Johnston et al., "Sum-Difference Stereo Transform Coding", proc. IEEE ICASSP 1992, pp. II-569-II-572.
Erik Schuijers et al., "Advances in Parametric Coding for High-Quality Audio", in Preprint 5852, 114th Audio Engineering Society convention, Mar. 2003.

* cited by examiner

FIG. 2

| Bitrate (kbps) | 13.2 | 16.4 | 24.4 | 32 | 48 | 64 |
|---|---|---|---|---|---|---|
| SWB | | | | | | |
| Speech | ACELP | ACELP | ACELP | ACELP | TCX | ACELP |
| Audio | GSC/TCX/ HQ MDCT | TCX/ HQ MDCT | TCX/ HQ MDCT | TCX/ HQ MDCT | TCX | HQ MDCT |
| FB | | | | | | |
| Speech | | ACELP | ACELP | ACELP | TCX | ACELP |
| Audio | | TCX | TCX/ HQ MDCT | TCX/ HQ MDCT | TCX | HQ MDCT |

| Threshold | Left and Right Channel different Level (Δ) | $W_1$ | $W_2$ |
|---|---|---|---|
| $\Delta \leq thr_L$ | Low level | 0.6 | 0.4 |
| $thr_L < \Delta \leq thr_M$ | Moderate level | 0.7 | 0.3 |
| $\Delta > thr_M$ | High level | 0.8 | 0.2 |

FIG. 14

| Coding Mode | Channel Correlation ( $\alpha$ ) | range |
|---|---|---|
| Mid-Side Coding | High | [ 0.6 1 ] |
| Dual Mono with mode alignment (DMA) | Weak | [ 0 0.6 ] |
| Dual Mono (DM) | Zero | 0 |

ENCODER AND ENCODING METHOD FOR SELECTING CODING MODE FOR AUDIO CHANNELS BASED ON INTERCHANNEL CORRELATION

TECHNICAL FIELD

The present disclosure relates to an encoder and an encoding method.

BACKGROUND ART

In recent years, EVS (Enhanced Voice Services) codec has been standardized in 3GPP (3rd Generation Partnership Project) (refer to, for example, NPL 1). The EVS codec is designed for encoding monophonic audio signals.

CITATION LIST

Non Patent Literature

NPL 1: 3GPP TS 26.445 V14.0.0, "Codec for Enhanced Voice services (EVS); Detailed algorithmic description (Release 14)", 2017-03

NPL 2: J. D. Johnston, A. J. Ferreira, "SUM-DIFFERENCE STEREO TRANSFORM CODING," proc. IEEE ICASSP1992, pp. 11-560-11-572, 1992

NPL 3: E. Schuijers, W. Oomen, B. Brinker, and J. Breebaart, "Advances in Parametric Coding for High-Quality Audio", in Preprint 5852, 114th AES convention, Amsterdam, March 2003.

SUMMARY OF INVENTION

The EVS codec does not support input and output of a stereo signal. However, if each of the right channel and left channel of a stereo signal is processed by using the mono encoding of the EVS codec, the EVS codec can be used in a stereo rendering system. However, if a stereo signal is encoded by using a multi-mode monaural codec that performs encoding by switching among a plurality of coding mode like the EVS codec, different coding modes may be used for the left channel and the right channel of the stereo signal. Consequently, the sound quality in stereo reproduction may deteriorate. Note that the monaural encoding performed separately for the L channel signal and the R channel signal of the stereo signal is also referred to as "dual mono encoding".

One aspect of the present disclosure provides an encoder and an encoding method capable of preventing a decrease in sound quality in stereo reproduction even when a stereo signal is encoded by using a multimode codec.

According to an aspect of the present disclosure, an encoder has a configuration including a calculation circuit that calculates an inter-channel correlation between a left channel and a right channel by using a left channel signal and a right channel signal that constitute a stereo signal and an encoding circuit that encodes the left channel signal and the right channel signal by using a common coding mode if the inter-channel correlation is greater than a threshold value and individually encodes the left channel signal and the right channel signal by using a coding mode determined for each of the left channel signal and the right channel signal if the inter-channel correlation is less than or equal to the threshold value.

According to an aspect of the present disclosure, an encoding method includes calculating an inter-channel correlation between a left channel and a right channel by using a left channel signal and a right channel signal that constitute a stereo signal and encoding the left channel signal and the right channel signal by using a common coding mode if the inter-channel correlation is greater than a threshold value and individually encodes the left channel signal and the right channel signal by using a coding mode determined for each of the left channel signal and the right channel signal if the inter-channel correlation is less than or equal to the threshold value.

It should be noted that general or specific embodiments may be implemented as a system, a method, an integrated circuit, a computer program, a storage medium, or any selective combination thereof.

According to one aspect of the present disclosure, even when a stereo signal is encoded by using a multimode codec, deterioration in sound quality can be prevented in stereo reproduction.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF DRAWINGS

FIG. 2 is a diagram illustrating an example of a correspondence relationship between a signal analysis parameter and a coding mode.

FIG. 14 is a diagram illustrating an example of a correspondence relationship between a range of an inter-channel correlation value and a coding mode according to the third embodiment.

DESCRIPTION OF EMBODIMENTS

Embodiments of the present disclosure are described in detail below with reference to the accompanying drawings.

A 3GPP EVS encoding system is briefly described first as an example of a multimode monaural encoding system (refer to, for example, NPL 1).

Figure 1:
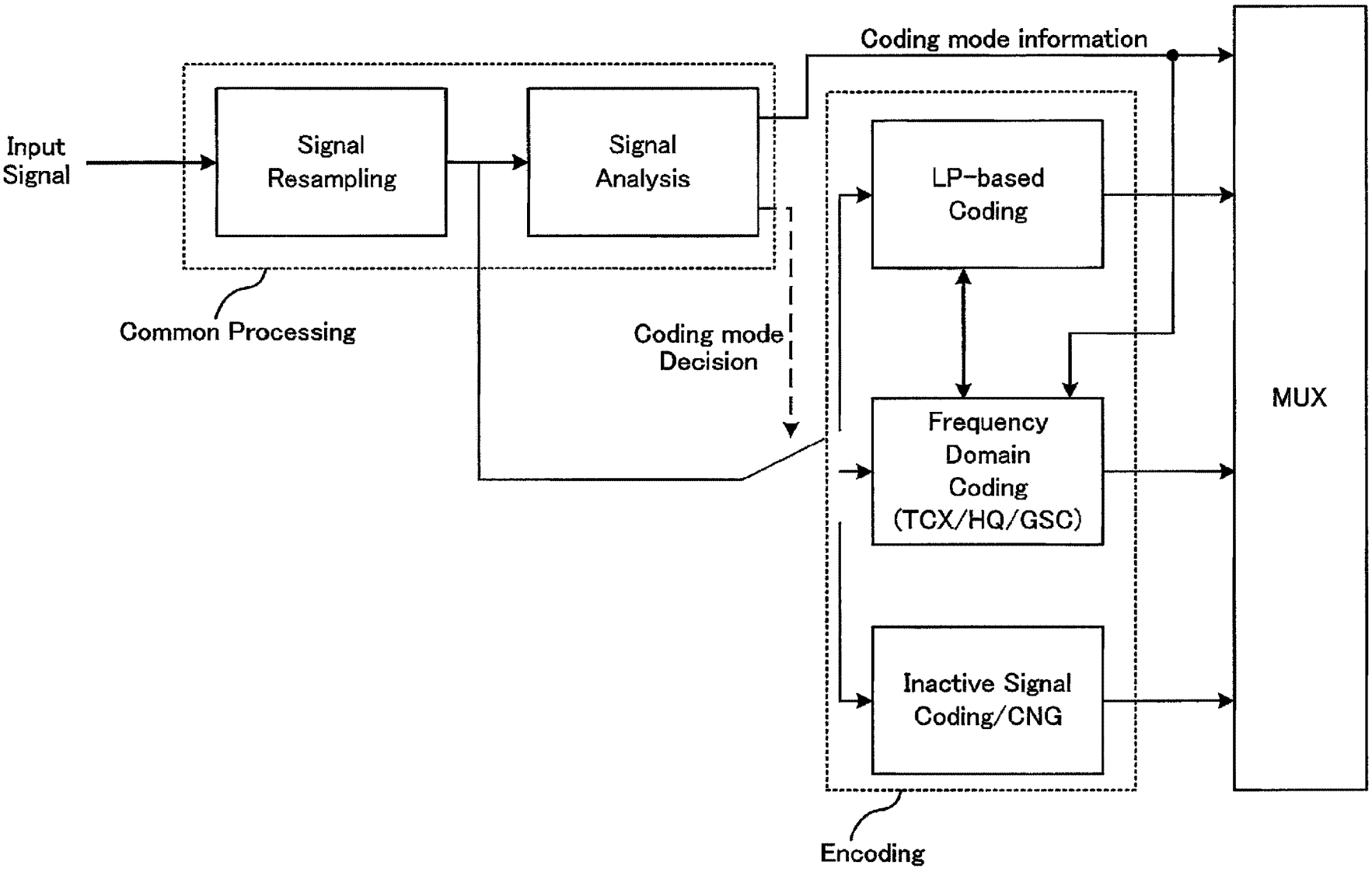
FIG. 1 is a diagram illustrating an example of the EVS codec.

As described in NPL 1, the EVS codec employs a plurality of encoding techniques (coding modes) (refer to, for example, FIG. 1). The plurality of encoding techniques employed in the EVS codec are basically based on the following two principles. One is a linear prediction (LP) based approach, and the other is a frequency domain approach. In linear prediction-based coding, a coding mode (for example, ACELP (Algebraic CELP)) optimized for each of bit rates is employed on the basis of the CELP (Code Excited Linear Prediction) coding technology. In the frequency domain approach, the HQ MDCT (High Quality Modified Discrete Cosine Transform) technology or the TCX (Transformed Code Excitation) technology is employed.

In the EVS codec, the most suitable coding mode is selected from among, for example, ACELP, HQ MDCT, and TCX in accordance with an input speech/audio signal. Each of the coding modes is designed and adjusted such that various signals can be efficiently coded. The coding mode selection in the EVS codec is made on the basis of, for example, the bit rate, the bandwidth of the audio signal, the speech/music classification, the selected coding mode, or other parameters (the features). FIG. 2 illustrates, as an example, a correspondence between each of parameters indicating the bit rate ([kbps]), bandwidth (SWB (super wideband), FB (fullband)), and input signal type (speech/audio) and one of the coding modes (ACELP, GSC, TCX, and HQ MDCT) to be selected according to the parameter.

As described above, the EVS codec is a monaural codec. However, if each channel of the stereo signal is processed by using a monaural codec, the EVC codec can be employed in a stereo rendering system. As an example, FIG. 3 illustrates an example of a configuration example of a dual mono encoder for processing each of the channels (left channel and right channel) of a stereo signal by using a monaural codec.

Figure 3:
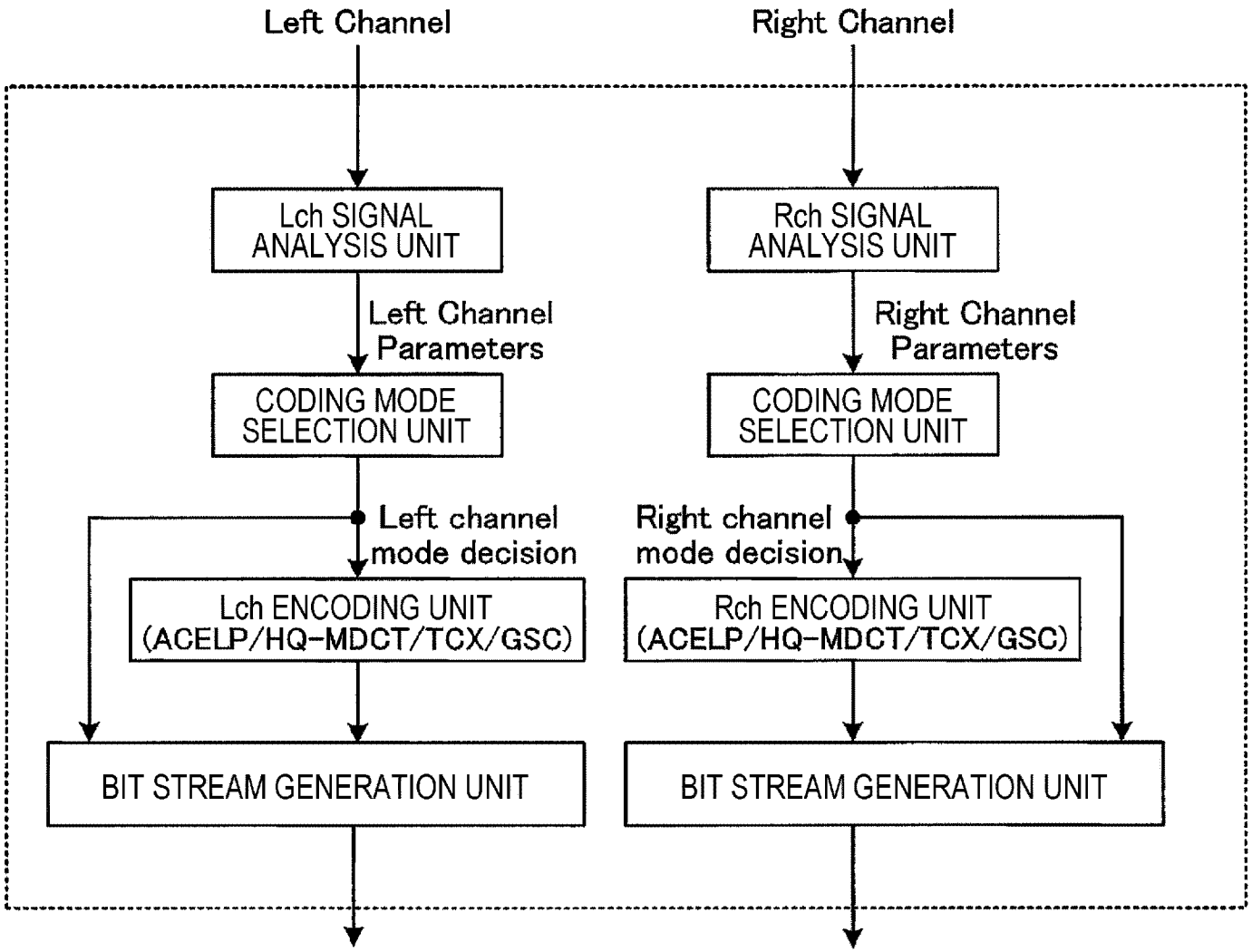
FIG. 3 is a diagram illustrating a configuration example of dual mono coding.

As illustrated in FIG. 3, the left channel signal (hereinafter referred to as an "L signal") and the right channel signal (hereinafter referred to as an "R signal") of a stereo signal are individually encoded by using a monaural codec. In this case, different coding modes may be selected for the left channel and the right channel of the stereo signal, and the stereo signal may be encoded. More specifically, the features of the L signal and the R signal vary according to the signal similarity between the channels. Accordingly, if the two channel signals are individually processed by a multimode codec, such as an EVS codec, different coding modes may be selected. If different coding modes are selected for the two channels, the subjective quality of the decoded signal may deteriorate, which causes abnormal sound and/or distortion in stereo reproduction or causes an inadequate stereo soundstage.

Accordingly, in each of the embodiments of the present disclosure, a method is described for preventing deterioration of the sound quality in stereo reproduction (preventing abnormal sound and/or distortion and an inadequate stereo soundstage) even when both channel signals of a stereo signal are processed individually by a multimode codec that performs encoding processing by switching among many coding modes.

First Embodiment

[Outline of Communication System]

A communication system according to the present embodiment includes an encoder 100 and a decoder (not illustrated).

Figure 4:
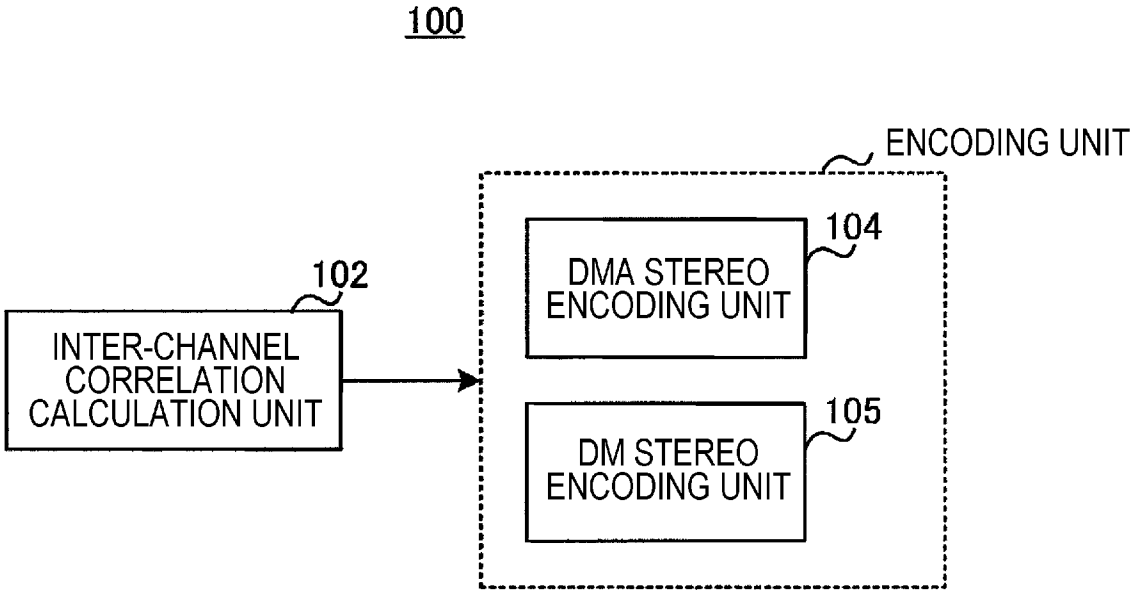
FIG. 4 is a block diagram illustrating a configuration example of part of an encoder according to a first embodiment.

FIG. 4 is a block diagram illustrating a partial configuration of the encoder 100 according to the present embodiment. In the encoder 100 illustrated in FIG. 4, an inter-channel correlation calculation unit 102 uses a left channel signal (L signal) and a right channel signal (R signal) that constitute a stereo signal and calculates an inter-channel correlation between the left channel and the right channel (a correlation coefficient). Encoding units (a DMA stereo encoding unit 104 and a DM stereo encoding unit 105) encode the left channel signal and the right channel signal by using a common coding mode if the inter-channel correlation is larger than a threshold value. However, if the inter-channel correlation is less than or equal to the threshold value, the encoding units individually encode the left channel signal and the right channel signal by using the coding mode determined for each of the left channel signal and the right channel signal.

[Configuration of Encoder]

Figure 5:
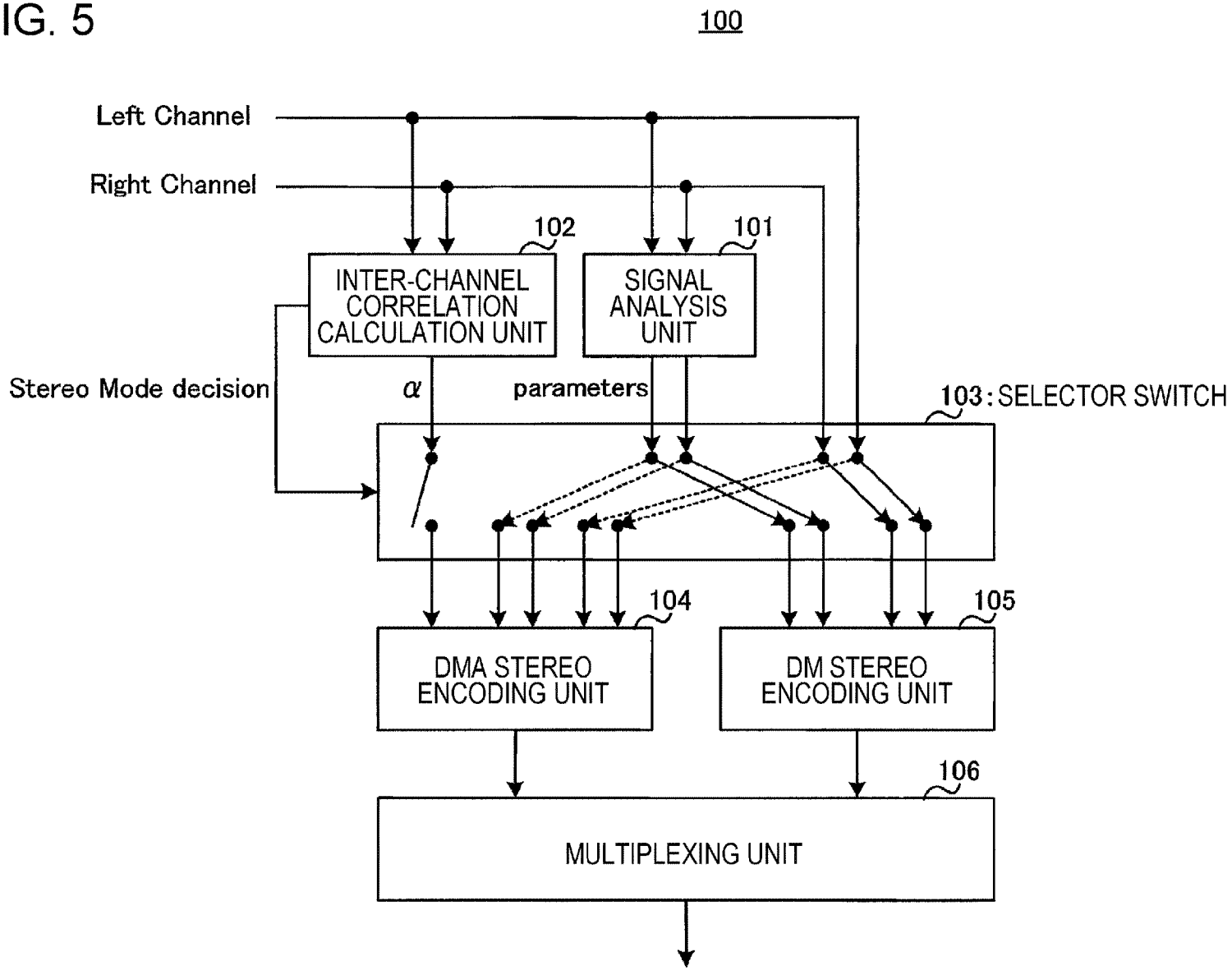
FIG. 5 is a block diagram illustrating a configuration example of the encoder according to the first embodiment.

FIG. 5 is a block diagram illustrating a configuration example of the encoder 100 according to the present embodiment. In FIG. 5, the encoder 100 includes a signal analysis unit 101, the inter-channel correlation calculation unit 102, a selector switch 103, the DMA (Dual Mono with mode alignment) stereo encoding unit 104, and the DM (Dual Mono) stereo encoding unit 105, and a multiplexing unit 106.

In FIG. 5, the L signal (Left channel) and the R signal (Right channel) that constitute a stereo signal are input to the signal analysis unit 101, the inter-channel correlation calculation unit 102, and the selector switch 103.

The signal analysis unit 101 performs signal analysis on the input L signal and R signal and obtains parameters necessary for determining the coding mode for each of the left channel and the right channel (for example, the feature, such as the bit rate, bandwidth, and type). The signal analysis unit 101 outputs the obtained analysis parameters to the selector switch 103. For example, during the signal analysis, the signal analysis unit 101 performs frequency domain transform processing and energy calculation processing on the channel signals.

The inter-channel correlation calculation unit 102 calculates the inter-channel correlation (the correlation coefficient) a between the left channel and the right channel on the basis of the input L signal and R signal by using, for example, the following equation (1):

[Formula 1]

$$\alpha = \frac{R_{12}}{(\sqrt{R_{11}})(\sqrt{R_{22}})} = \frac{\left|\sum_{k=1}^{Frame_{length}} l(k)R^*(k)\right|}{\left(\sqrt{\sum_{k=1}^{Frame_{Length}} l(k)l^*(k)}\right)\left(\sqrt{\sum_{k=1}^{Frame_{Length}} R(k)R^*(k)}\right)}. \quad (1)$$

In equation (1), $R_{11}$ and $R_{22}$ represent the energy (autocorrelation) of the L signal and the R signal, respectively (for example, Ru corresponds to the L signal, and $R_{22}$ corresponds to the R signal). $R_{12}$ represents a cross spectrum between the L signal and the R signal. $Frame_{length}$ represents the number of frequency spectrum parameters (spectral coefficients) in the frame, I(k) represents the kth spectral coefficient in the L signal, and R(k) represents the kth spectral coefficient in the R signal.

In addition, the inter-channel correlation calculation unit 102 determines a stereo coding mode for the stereo signal (the L signal and R signal) on the basis of the calculated correlation coefficient α.

As used herein, as illustrated in FIG. 3, examples of the stereo coding mode include a mode in which the coding mode is individually selected for the L signal and the R signal (hereinafter referred to as a "dual mono coding mode" or a "DM stereo coding mode") and, as is described later, a mode in which a common coding mode is selected for the L signal and the R signal, and the signals are encoded (hereinafter referred to as a "common dual mono coding mode" or a "DMA stereo coding mode").

More specifically, the inter-channel correlation calculation unit 102 selects the DM stereo coding mode if the correlation coefficient α is less than or equal to a threshold value and selects the DMA stereo coding mode if the correlation coefficient α is greater than the threshold value. As an example, the inter-channel correlation calculation unit 102 may select the DM stereo coding mode if the correlation coefficient α is 0 (that is, if there is no correlation between the L signal and the R signal) and may select the DMA stereo coding mode if the correlation coefficient α is greater than 0 (α>0).

The inter-channel correlation calculation unit 102 outputs, to the selector switch 103, the correlation coefficient α and a stereo mode decision flag (stereo mode decision) that is a determination result of the stereo coding mode.

If the stereo mode decision flag input from the inter-channel correlation calculation unit 102 indicates the DMA stereo coding mode, the selector switch 103 outputs, to the DMA stereo encoding unit 104, the input L signal, the R signal, the analysis parameters input from the signal analysis unit 101, and the correlation coefficient α input from the correlation calculation unit 101. However, if the stereo mode decision flag indicates the DM stereo coding mode, the selector switch 103 outputs, to the DM stereo encoding unit 105, the L signal, the R signal, and the analysis parameters.

The DMA stereo encoding unit 104 determines (selects) a common coding mode for the L signal and the R signal by using the correlation coefficient α and the analysis parameters. Thereafter, the DMA stereo encoding unit 104 encodes the L signal and the R signal by using the determined common coding mode and outputs the generated encoded bit streams to the multiplexing unit 106. A method for selecting the coding mode performed by the DMA stereo encoding unit 104 is described in more detail below.

The DM stereo encoding unit 105 determines (selects) a coding mode for each of the L signal and the R signal by using the analysis parameters. Thereafter, the DM stereo encoding unit 105 encodes each of the L signal and the R signal by using the determined coding mode and outputs the generated encoded bit stream to the multiplexing unit 106 (refer to, for example, FIG. 3).

The multiplexing unit 106 multiplexes the encoded bit streams input from the DMA stereo encoding unit 104 or the DM stereo encoding unit 105. The multiplexed bit stream is transmitted to a decoder (not illustrated).

Note that instead of including the selector switch 103, the DMA stereo encoding unit 104, and the DM stereo encoding unit 105, the encoder 100 illustrated in FIG. 5 may be configured to include an encoding unit (not illustrated) having a function of these constituent units. That is, the encoding unit is only required to determine a stereo coding mode (the DMA stereo encoding or the DM stereo encoding) in accordance with the inter-channel correlation (the correlation coefficient α) received from the inter-channel correlation calculation unit 102 and encode each of the L signal and R signal that constitute the stereo signal by using the determined stereo coding mode.

[Operation Performed by DMA Stereo Encoding Unit 104]

The method for selecting a coding mode in the DMA stereo encoding unit 104 is described in detail below.

Figure 6:
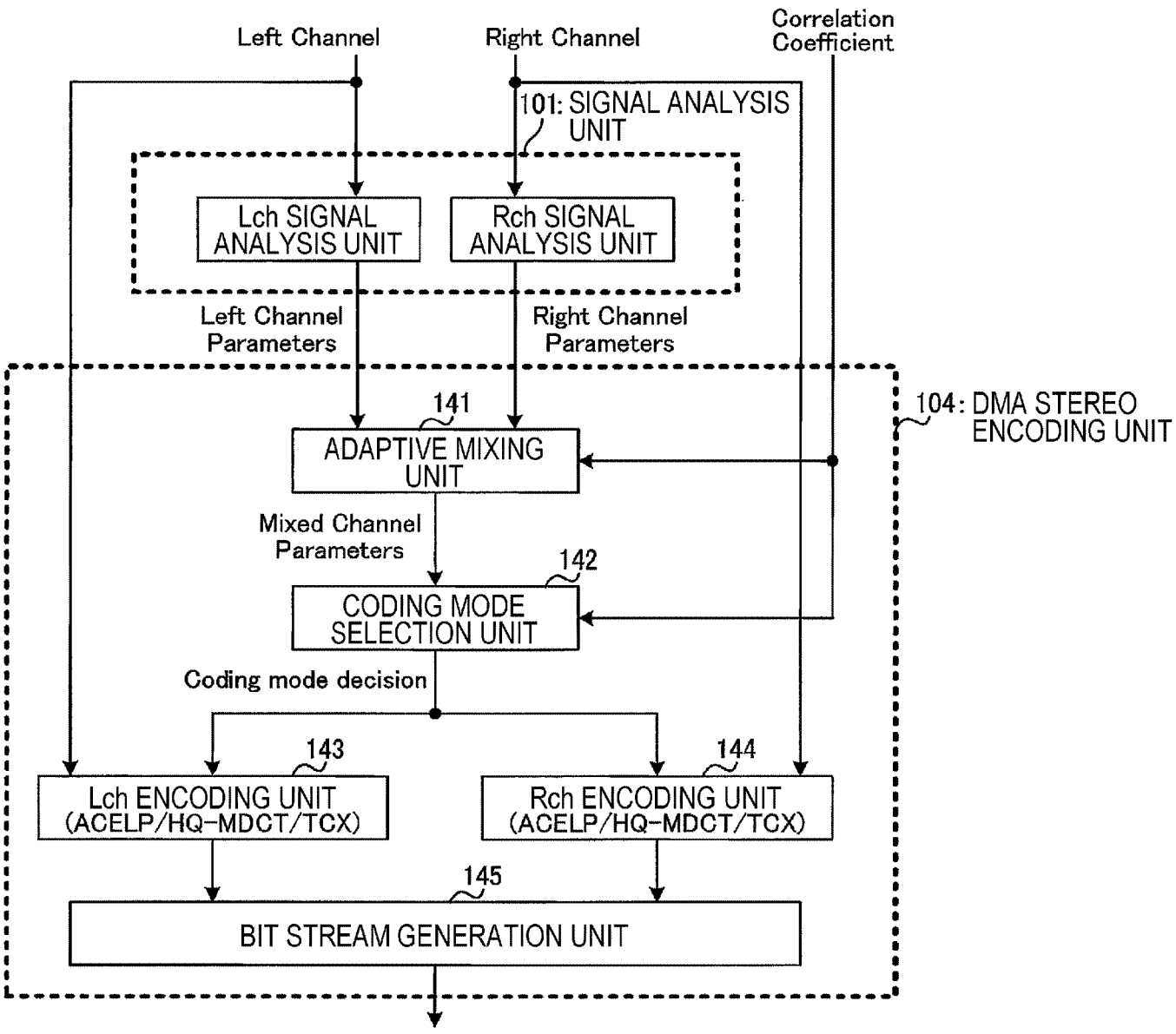
FIG. 6 is a block diagram illustrating a configuration example of a signal analysis unit and a DMA stereo encoding unit according to the first embodiment.

FIG. 6 is a block diagram illustrating the configuration of the signal separating unit 101 and the DMA stereo encoding unit 104 illustrated in FIG. 5. In FIG. 6, the DMA stereo encoding unit 104 is configured to include an adaptive mixing unit 141, a coding mode selection unit 142, an Lch encoding unit 143, an Rch encoding unit 144, and a bit stream generation unit 145.

As illustrated in FIG. 6, the adaptive mixing unit 141 receives the Lch analysis parameters (Left channel parameters) obtained by performing signal analysis on the L signal in the signal analysis unit 101 (an Lch signal analysis unit) via the selector switch 103 (not illustrated). Similarly, as illustrated in FIG. 6, the adaptive mixing unit 141 receives the Rch analysis parameters (Right channel parameters) obtained by performing signal analysis on the R signal in the signal analysis unit 101 (an Rch signal analysis unit) via the selector switch 103 (not illustrated).

The adaptive mixing unit 141 performs mixing on the Lch analysis parameters and Rch analysis parameters input from the signal analysis unit 101 on the basis of the correlation coefficient α input from the inter-channel correlation calculation unit 102 (refer to FIG. 5) and outputs the post-mixing analysis parameters (Mixed channel parameters) to the coding mode selection unit 142. That is, the analysis parameters after mixing represent a common parameters (the feature) for determining the coding mode for each of the L signal and the R signal.

The coding mode selection unit 142 uses the post-mixing analysis parameters input from the adaptive mixing unit 141 and selects a coding mode to be commonly applied to both the L signal and R signal. The method for selecting a coding mode in the coding mode selection unit 142 may be the same as the selection method employed in the EVS codec (monaural encoding) illustrated in FIG. 2 in accordance with the post-mixing analysis parameters, for example. The coding mode selection unit 142 outputs coding mode information (coding mode decision) indicating the selected coding mode to the Lch encoding unit 143 and the Rch encoding unit 144.

The Lch encoding unit 143 encodes the L signal by using the coding mode indicated by the coding mode information input from the coding mode selection unit 142 and outputs a generated encoded bit stream to the bit stream generation unit 145.

The Rch encoding unit 144 encodes the R signal by using the coding mode indicated by the coding mode information input from the coding mode selection unit 142 and outputs a generated encoded bit stream to the bit stream generation unit 145.

The bit stream generation unit 145 generates a stereo encoded bit stream by using the encoded bit stream input from the Lch encoding unit 143 and the encoded bit stream input from the Rch encoding unit 144 and outputs the stereo encoded bit stream to the multiplexing unit 106 (refer FIG. 5).

Figure 7:
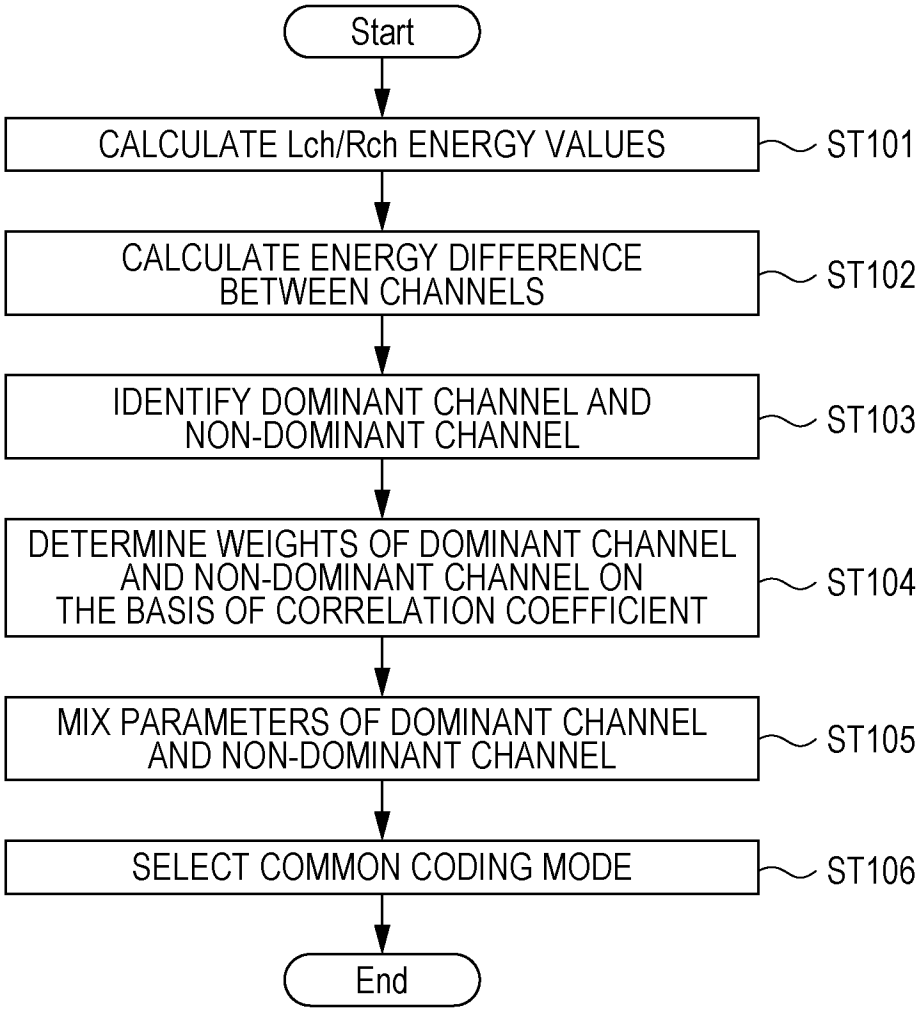
FIG. 7 is a flowchart illustrating the flow of coding mode selection processing according to the first embodiment.

FIG. 7 is a flowchart illustrating a main flow of the coding mode selection processing in the DMA stereo coding mode according to the present embodiment.

The signal analysis unit 101 (the Lch signal analysis unit and Rch analysis unit) calculates the energy of the L signal (the left channel) and the R signal (the right channel) (ST101). Subsequently, the adaptive mixing unit 141 calculates inter-channel energy difference 4 by using the energy of each of the channels calculated in ST101 (ST102).

Subsequently, the adaptive mixing unit 141 identifies a dominant channel and a non-dominant channel for the L signal (the left channel) and the R signal (the right channel) (ST103).

For example, the adaptive mixing unit 141 may identify the dominant channel and the non-dominant channel on the basis of the inter-channel energy difference Δ calculated in ST102. For example, the inter-channel energy difference Δ is given by the following equation (2):

[Formula 2]

$$\Delta = R_{11} - R_{22} \tag{2}$$

In equation (2), let Ru denote the energy of the left channel, and let $R_{22}$ denote the energy of the right channel. Then, the adaptive mixing unit 141 identifies the dominant channel and the non-dominant channel in accordance with the sign of the inter-channel energy difference Δ. More specifically, if the energy difference Δ is positive (Δ>0, that is, $R_{11}>R_{22}$), the adaptive mixing unit 141 identifies that the left channel is the dominant channel, and the right channel is the non-dominant channel. However, if the energy difference Δ is negative (Δ<0, that is, $R_{11}<R_{22}$), the adaptive mixing unit 141 identifies that the left channel is a non-dominant channel, and the right channel is a dominant channel. Note that the method for identifying the dominant channel and the non-dominant channel is not limited to the above-described method.

Subsequently, the adaptive mixing unit 141 determines a weighting coefficient (a weight) for the analysis parameter of the dominant channel and the analysis parameter of the non-dominant channel identified in ST103 on the basis of the correlation coefficient α (ST104). Thereafter, the adaptive mixing unit 141 performs mixing (adaptive mixing) of analysis parameters by calculating the weighted sum of the analysis parameter of the dominant channel and the analysis parameter of the non-dominant channel by using the weighting coefficients determined in ST104 (ST105).

For example, the adaptive mixing unit 141 performs mixing of the analysis parameters (calculates the weighted sum) to obtain an analysis parameter (a weighted parameter) $M_p$ by using the following equation (3):

[Formula 3]

$$M_p = W_1 D_p + W_2 ND_p \tag{3}$$

In equation (3), $D_p$ represents an analysis parameter for determining the coding mode of the dominant channel, and $ND_p$ represents an analysis parameter for determining the coding mode of the non-dominant channel. $W_1$ represents a weighting coefficient for the analysis parameter of the dominant channel, and $W_2$ represents a weighting coefficient for the analysis parameter of the non-dominant channel. $W_1$ and $W_2$ are given by the following equation (4):

[Formula 4]

$$W_1 = \max(1-\alpha, 0.6)$$

$$W_2 = 1 - W_1 \tag{4}$$

Note that the range of the normalized correlation coefficient (hereinafter simply referred to as a "correlation coefficient") α is $0<\alpha<1$.

That is, the minimum value of the weighting coefficient $W_1$ is 0.6, and the maximum value of the weighting coefficient $W_2$ is 0.4. Accordingly, the weighting coefficient $W_1$ is greater than the weighting coefficient $W_2$, regardless of the correlation coefficient α between the left channel and the right channel. Therefore, the relationship, Weighting coefficient $W_1$>Weighting coefficient $W_2$, holds.

That is, the adaptive mixing unit 141 increases the weighting coefficient of the analysis parameter of the dominant channel as compared with the analysis parameter of the non-dominant channel and obtains the analysis parameter M. In this manner, the analysis parameter $M_p$ obtained through weighted sum has a value that emphasizes the analysis parameter of the dominant channel more than that of the non-dominant channel.

In addition, the weighting coefficient $W_1$ for the analysis parameter of the dominant channel increases and, in contrast, the weighting coefficient $W_2$ for the analysis parameters of the non-dominant channel decreases with decreasing correlation coefficient α indicating the inter-channel correlation between the left channel and the right channel.

That is, in the example indicated by equation (4), a large weight is reliably applied to the dominant channel at all times. In addition, if the inter-channel correlation (the correlation coefficient α) increases, the weights of both channels are closer to the same value. That is, since the analysis parameters calculated for both channels are similar if the inter-channel correlation is high, there is no need to particularly emphasize the dominant channel. Accordingly, weighting is performed such that the weights of both channels are close to each other. However, if the inter-channel correlation is low, it is highly likely that the difference between the analysis parameters calculated for two channels is large. Accordingly, weighting is performed such that the weight of the analysis parameter obtained from the dominant channel is given priority (emphasized) over that of the non-dominant channel.

As described above, the adaptive mixing unit 141 mixes the analysis parameters by adjusting the weighting between the dominant channel and the non-dominant channel in accordance with the inter-channel correlation (the correlation coefficient α).

As an example, the case where the correlation coefficient α=0.7 is described below. In this case, the weighting coefficient $W_1$ and the weighting coefficient $W_2$ are given by the following equations (5):

[Formula 5]

$$W_1=\max(1-0.7,0.6)=0.6$$

$$W_2=1-0.6=0.4 \quad (5)$$

Note that if the analysis parameter is n-dimensional, the adaptive mixing unit 141 may obtain the post-mixing analysis parameter $M_p$, as given by the following equation (6):

[Formula 6]

$$M_p = W_1\begin{bmatrix} ParaD_{TCX-HQ}(1) \\ \vdots \\ ParaD_{TCX-HQ}(n) \end{bmatrix} + W_2\begin{bmatrix} ParaND_{TCX-HQ}(1) \\ \vdots \\ ParaND_{TCX-HQ}(n) \end{bmatrix}. \quad (6)$$

In equation (6), $ParaD_{TCX-HQ}$ represents the analysis parameter of the dominant channel, and $ParaND_{TCX-HQ}$ represents the analysis parameter of the non-dominant channel.

Finally, the coding mode selection unit 142 selects a coding mode common to both the L signal and the R signal by using the analysis parameter $M_p$ obtained in ST105 (ST106). The method for selecting a coding mode employed by the coding mode selection unit 142 may be the same as the selection method in the EVS codec (monaural encoding) illustrated in FIG. 2.

As described above, according to the present embodiment, the encoder 100 commonalizes the coding mode used for encoding each of the channel signals if there is a correlation between the channels of the stereo signal. In this manner, even when the subjective quality of the decoded signal deteriorates under the condition that different coding modes are selected for the two channels of the stereo signal, the encoder 100 can prevent the deterioration of the subjective quality of the decoded signal by performing encoding using the common coding mode for the two channels of the stereo signal. Thus, according to the present embodiment, even when a stereo signal is encoded by using a multimode monaural codec that performs encoding processing by switching among a plurality of coding modes, deterioration of the sound quality in stereo reproduction can be prevented.

In addition, when selecting a common coding mode, the encoder 100 identifies the dominant channel and the non-dominant channel, emphasizes the analysis parameter of the dominant channel in accordance with the correlation coefficient α, and mixes the analysis parameters. That is, according to the present embodiment, the encoder 100 can appropriately select a common coding mode by adjusting the enhancement levels of the analysis parameters in accordance with the inter-channel correlation between the two channels.

In contrast, if there is no correlation between the channels of the stereo signal, the encoder 100 individually selects a coding mode used for encoding each of the channel signals. In this manner, the optimum coding mode is selected for each of the channels of the stereo signal.

As described above, according to the present embodiment, the encoder 100 can select an appropriate coding mode for each of the channels in accordance with the inter-channel correlation between the two channels of the stereo signal. As a result, the sound quality can be improved.

[Modification 1 of First Embodiment]

According to the first embodiment, the case has been described where the encoder 100 determines the weighting coefficient for the analysis parameter of each of the channels on the basis of the correlation coefficient α. However, the method for determining the weighting coefficient is not limited thereto. According to Modification 1, as an example, a method for determining a weighting coefficient on the basis of the energy difference between the channels instead of the correlation coefficient α is described.

Figure 8:
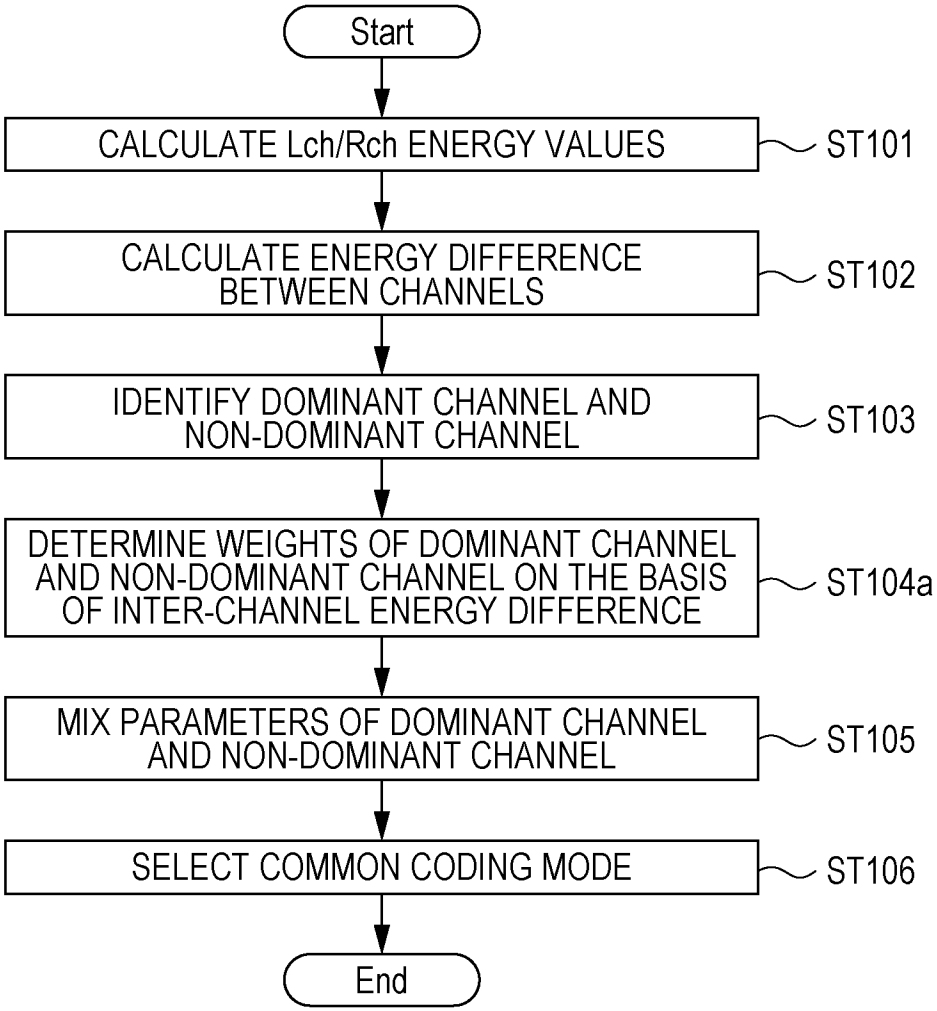
FIG. 8 is a flowchart illustrating the flow of a coding mode selection process according to a modification of the first embodiment.

FIG. 8 is a flowchart illustrating the flow of the main processing performed by the DMA stereo encoding unit 104 according to the present embodiment. The same reference numerals are used in FIG. 8 to describe those processes that are identical to the processes in FIG. 7, and the description of the processes are not repeated.

More specifically, in ST104*a* illustrated in FIG. 8, the adaptive mixing unit 141 (refer to FIG. 6) determines the weighting coefficient (the weight) for each of the analysis parameters of the dominant channel and the non-dominant channel identified in ST103 on the basis of the inter-channel energy difference Δ calculated in ST102.

More specifically, the adaptive mixing unit 141 increases the weighting coefficient $W_1$ for the analysis parameter of the dominant channel and decreases the weighting coefficient $W_2$ for the analysis parameter of the non-dominant channel with increasing inter-channel energy difference Δ. That is, the adaptive mixing unit 141 performs weighting such that the dominant channel is more prioritized (emphasized) over the non-dominant channel with increasing inter-channel energy difference Δ.

Figures 9, 10:
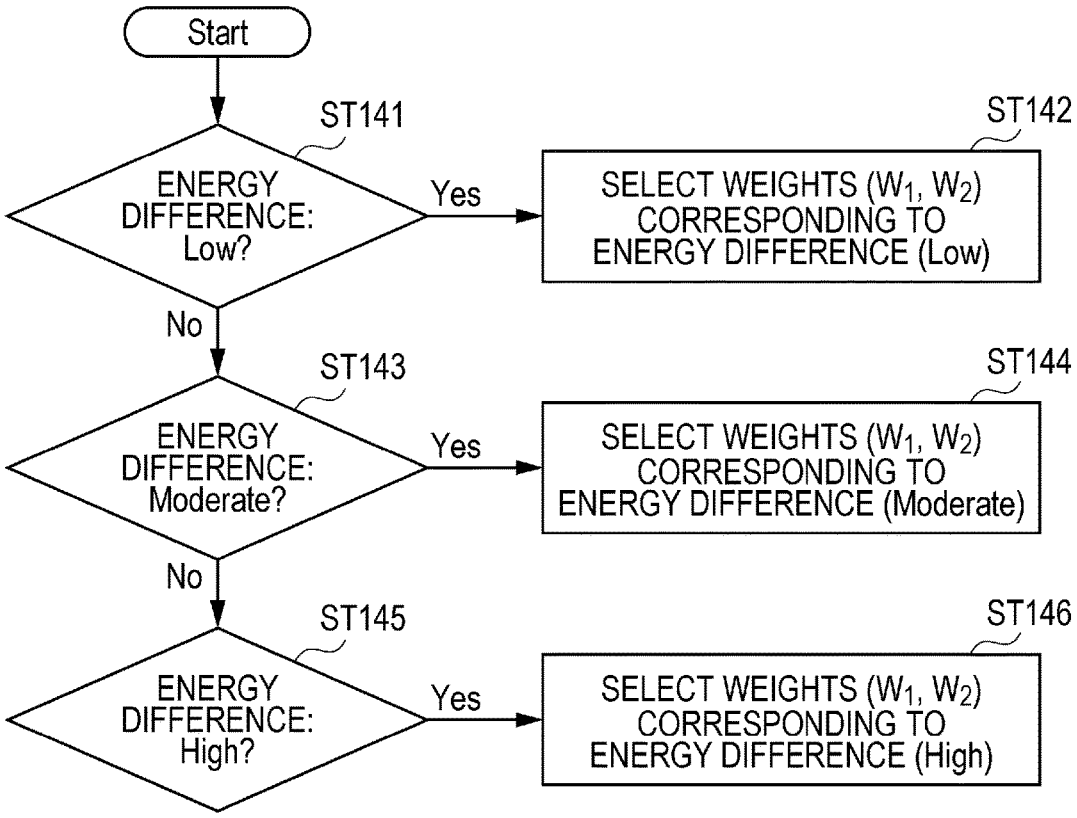
FIG. 9 is a flowchart illustrating the flow of weighting coefficient selection processing according to a modification of the first embodiment.
FIG. 10 is a diagram illustrating an example of a correspondence relationship between an inter-channel energy difference and a weighting coefficient according to a modification of the first embodiment.

FIG. 9 is a flowchart illustrating an example of the process (ST104*a* in FIG. 8) performed by the adaptive mixing unit 141 for determining the weighting coefficients. FIG. 10 is a diagram illustrating an example of a correspondence relationship between the inter-channel energy difference Δ and the weighting coefficients ($W_1$, $W_2$).

The adaptive mixing unit 141 determines whether the inter-channel energy difference Δ is small (for example, whether Δ≤a threshold $thr_L$) (ST141). If the inter-channel energy difference Δ is small (ST141: Yes), the adaptive mixing unit 141 selects the weighting coefficients corresponding to the case where the inter-channel energy difference Δ is small (Δ: Low level) (in FIG. 10, ($W_1$=0.6, $W_2$=0.4 (ST142).

In addition, the adaptive mixing unit 141 determines whether the inter-channel energy difference Δ is at an intermediate level (for example, whether the threshold value $thr_L<\Delta\leq thr_M$) (ST143). If the inter-channel energy difference Δ is at an intermediate level (ST143: Yes), the adaptive mixing unit 141 selects the weighting coefficients corresponding to the case where the inter-channel energy difference Δ is at an intermediate level (Δ: Moderate level) (in FIG. 10, ($W_1$=0.7, $W_2$=0.3) (ST144).

Furthermore, the adaptive mixing unit 141 determines whether the inter-channel energy difference Δ is large (for example, whether $\Delta>thr_M$) (ST145). If the inter-channel energy difference Δ is large (ST145: Yes), the adaptive mixing unit 141 selects the weighting coefficients corresponding to the case where the inter-channel energy difference Δ is large (Δ: High level) (in FIG. 10, ($W_1$=0.8, $W_2$=0.2) (ST146).

The influence of the dominant channel on a stereo signal is highly likely to increase with increasing the inter-channel energy difference Δ, as compared with the non-dominant channel. For this reason, in the example illustrated in FIG. 10, like equation (4), weighting is performed such that the weight of the analysis parameter obtained from the dominant channel is given greater priority (more emphasized) with increasing inter-channel energy difference Δ while ensuring that a greater weight is given to the dominant channel at all times.

Thus, according to Modification 1, the adaptive mixing unit 141 mixes the analysis parameters by adjusting the weights given to the analysis parameters of the dominant channel and the non-dominant channel in accordance with the inter-channel energy difference Δ.

As described above, when mixing the analysis parameters, the encoder 100 changes the enhancement level of the analysis parameter of the dominant channel in accordance with the energy difference between the dominant channel and the non-dominant channel of the stereo signal. In this manner, if the energy difference between the channels is large, the encoder 100 can select a common coding mode by using an analysis parameter that emphasizes the dominant channel more. However, if the energy difference between channels is small, the encoder 100 can select a common coding mode by using an analysis parameter that reflects the non-dominant channel more. In general, signal analysis is performed after normalization with energy is performed. In such a case, the analysis parameter does not reflect the magnitude of energy. For this reason, emphasis on the parameter of the dominant channel in accordance with the energy difference is effective for mixing in the analysis parameter region.

[Modification 2 of First Embodiment]

The values used in the description of First embodiment (for example, the minimum value of $W_1$ in Expression (4): 0.6, the weighting coefficient illustrated in FIG. 10) are only illustrative. Other values can be employed.

In addition, equation (4) indicates an example in which the weighting coefficient is obtained on the basis of the correlation coefficient α. However, the present invention is not limited thereto. For example, the weighting coefficient can be determined on the basis of both the correlation between the channels (the correlation coefficient α) and the inter-channel energy difference Δ.

More specifically, the adaptive mixing unit 141 may calculate weighting coefficients by using the following equation (7):

[Formula 7]

$$W_1=\max(1-\alpha,\beta)$$

$$W_2=1-W_1 \tag{7}$$

In equation (7), β represents a value set on the basis of the inter-channel energy difference Δ. For example, in the same manner as the correspondence relationship between the inter-channel energy difference Δ and the weighting coefficient $W_1$ in FIG. 10, the value of β may be increased with increasing inter-channel energy difference Δ. In this manner, the weighting coefficient $W_1$ (the minimum value β) for the analysis parameter of the dominant channel increases with increasing inter-channel energy difference Δ.

In this way, the adaptive mixing unit 141 can mix the analysis parameters by adjusting the emphasis levels (the priorities) of the dominant channel and the non-dominant channel in accordance with both the signal similarity between the channels based on the channel correlation and the inter-channel energy difference.

Second Embodiment

If the determination result (the selection result) of the coding mode is frequently switched between frames, the subjective quality of the decoded signal may deteriorate. Therefore, according to the present embodiment, a method is described for preventing frequent switching of the coding mode determination result between frames.

[Configuration of Encoder]

An encoder according to the present embodiment has the same basic configuration as the encoder 100 according to the first embodiment and, thus, is described with reference to FIG. 5. However, according to the present embodiment, the encoder 100 includes a DMA stereo encoding unit 150 illustrated in FIG. 11 instead of the DMA stereo encoding unit 104 illustrated in FIG. 5.

Figure 11:
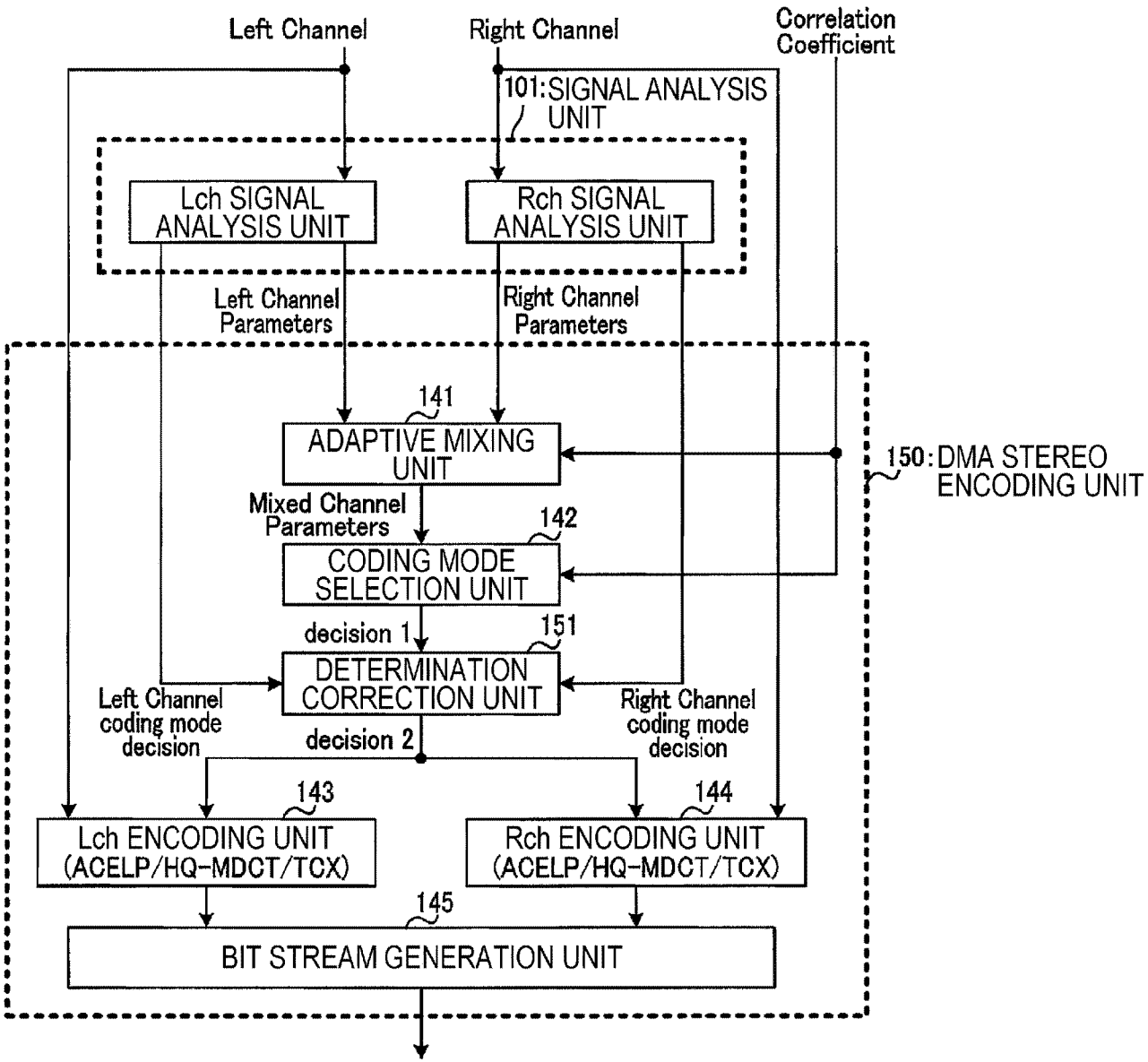
FIG. 11 is a block diagram illustrating a configuration example of a signal analysis unit and a DMA stereo encoding unit according to a second embodiment.

FIG. 11 is a block diagram illustrating a configuration example of the DMA stereo encoding unit 150 according to the present embodiment.

Note that the same reference numerals are used in FIG. 11 to describe those configurations that are identical to the configurations of the first embodiment (FIG. 6), and the description of the configurations are not repeated. More specifically, the DMA stereo encoding unit 150 illustrated in FIG. 11 further includes a determination correction unit 151, as compared with the configuration of the first embodiment (FIG. 6).

Furthermore, according to the present embodiment, in addition to performing the processes of the first embodiment, the signal analysis unit 101 (the Lch signal analysis unit) outputs, to the determination correction unit 151, an Lch coding mode determination result (Left channel coding mode decision) indicating the coding mode determined on the basis of the Lch analysis parameter (refer to, for example, FIG. 2). Similarly, in addition to performing the processes of the first embodiment, the signal analysis unit 101 (the Rch signal analysis unit) outputs, to the determination correction unit 151, an Rch coding mode determination result (Right channel coding mode decision) indicating the coding mode determined on the basis of the Rch analysis parameter (refer to, for example, FIG. 2).

In the DMA stereo encoding unit 150, the determination correction unit 151 determines whether the coding mode determination result input from the coding mode selection unit 142 is to be corrected on the basis of the coding mode applied to the previous frame and the Lch coding mode determination result and the Rch coding mode determination result input from the signal analysis unit 101.

As used herein, the coding mode input to the determination correction unit 151 is referred to as "decision 1", and the coding mode output from the determination correction unit 151 is referred to as "decision 2".

If the determination correction unit 151 determines that correction of the coding mode determination result is not needed, the determination correction unit 151 outputs the coding mode determination result to the Lch encoding unit 143 and the Rch encoding unit 144 without any correction. However, if the determination correction unit 151 determines that correction of the coding mode determination result is needed, the determination correction unit 151 corrects the coding mode determination result and outputs the corrected coding mode determination result to each of the Lch encoding unit 143 and the Rch encoding unit 144.

Figure 12:
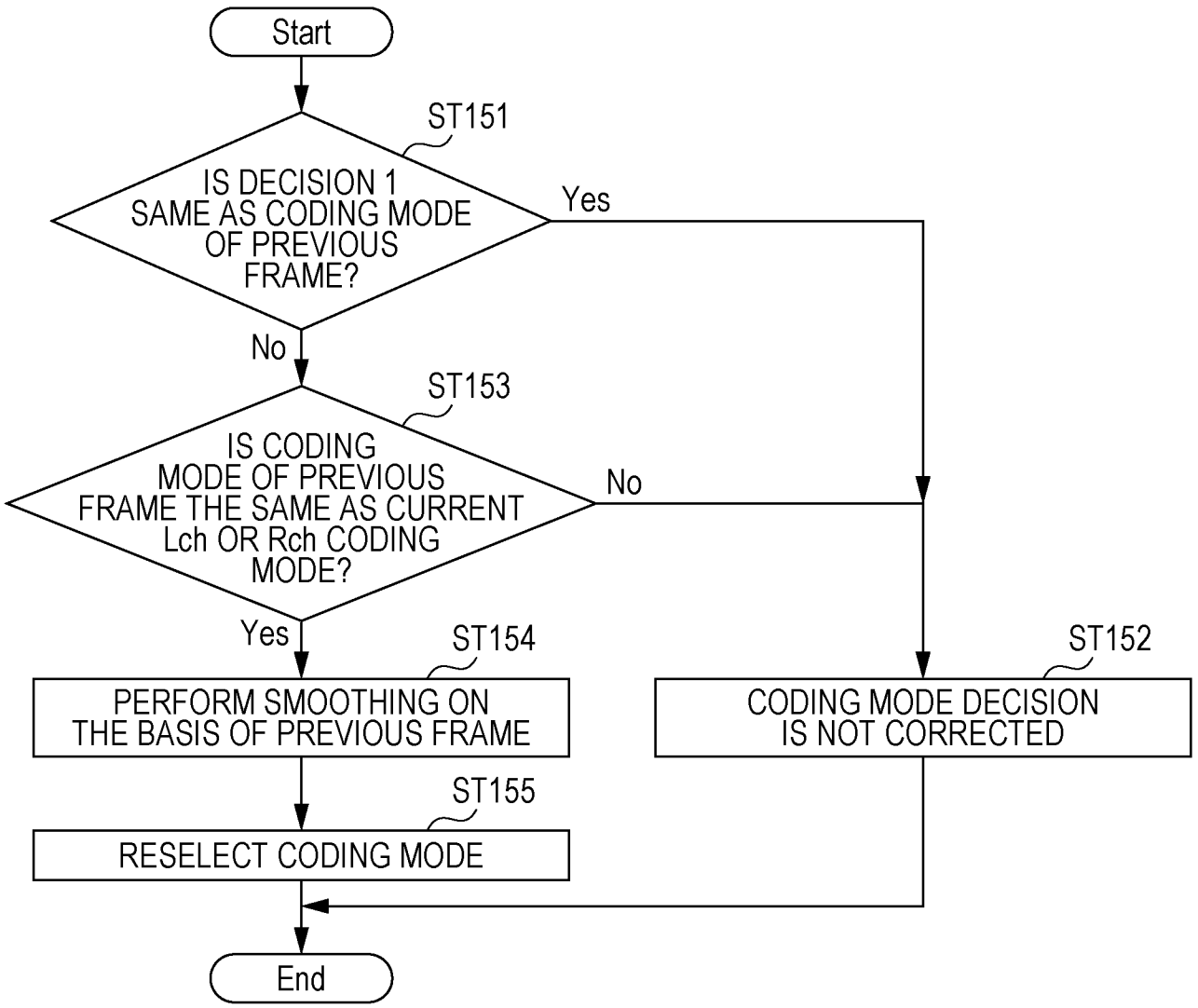
FIG. 12 is a flowchart illustrating the flow of coding mode determination correction processing according to the second embodiment.

FIG. 12 is a flowchart illustrating an example of the coding mode determination correction process performed by the determination correction unit 151.

In FIG. 12, the determination correction unit 151 determines whether the coding mode determination result (decision 1) of the current frame in the coding mode selection unit 142 is the same as the coding mode applied to a previous frame (for example, the immediately previous frame) (ST151).

If the coding mode determination result (decision 1) is the same as the coding mode of the previous frame (ST151: Yes), the determination correction unit 151 completes the processing without performing the correction process on the coding mode determination result (decision 1) (ST152).

However, if the coding mode determination result (decision 1) is not the same as the coding mode of the previous frame (ST151: No), the determination correction unit 151 determines whether the coding mode used in the previous frame (for example, the immediately previous frame) is the same as one of the Lch coding mode determination result of the current frame and the Rch coding mode determination result of the current frame (ST153).

If, in ST153, the coding mode used in the previous frame is not the same as the Lch coding mode determination result of the current frame or the Rch coding mode determination result of the current frame (ST153: No), the determination correction unit 151 completes the processing without performing the correction process on the coding mode determination result (decision 1) (ST152).

However, if the coding mode of the previous frame is the same as the Lch coding mode determination result of the current frame or the Rch coding mode determination result of the current frame (ST153: Yes), the determination correction unit 151 performs a correction process (a smoothing process) on the coding mode determination result (decision 1) by using the coding mode determination result of the current frame and the coding mode of the previous frame (ST154).

That is, if the common coding mode (decision 1) selected for the current frame differs from the common coding mode selected for the previous frame and if the common coding mode selected for the previous frame is the same as the Lch coding mode determination result of the current frame or the Rch coding mode determination result of the current frame, the determination correction unit 151 reselects (corrects) the common coding mode for the current frame.

For example, the determination correction unit 151 corrects the analysis parameter $M_p$ used in the decision-1 determination process by using the following equation (8):

[Formula 8]

$$M_p = WM_p^{[-1]} + (1-W)M_p \tag{8}$$

In equation (8), $M_p^{[-1]}$ indicates an analysis parameter $M_p$ of the immediately previous frame (the previous frame), and W indicates a smoothing coefficient. For example, setting may be made so that W=0.8. Note that the value of the smoothing coefficient W is not limited to 0.8. In addition, the previous frame to be subjected to the smoothing process is not limited to the immediately previous frame as indicated by equation (8). For example, the smoothing process may be performed on a plurality of previous frames.

After the smoothing process is completed, the determination correction unit 151 performs reselection (redetermination) of the coding mode by using the corrected analysis parameter $M_p$ (ST155). Note that a method for selecting the coding mode at the time of reselecting the coding mode may be the same as that performed by the coding mode selection unit 142.

In this manner, the analysis parameter $M_p$ is smoothened over the immediately previous frame and the current frame. In addition, as indicated by equation (8), the corrected analysis parameter $M_p$ is more influenced by the analysis parameter $M_p^{[-1]}$ of the previous frame with increasing smoothing coefficient W. That is, in reselection of the coding mode based on the corrected analysis parameter $M_p$, the coding mode used in the previous frame is more frequently selected with increasing smoothing coefficient W.

In this way, according to the present embodiment, frequent switching of the determination result (selection result) of a coding mode between frames can be prevented. As a result, deterioration of the subjective quality of a decoded signal can be prevented.

Third Embodiment

[Configuration of Encoder]

Figure 13:
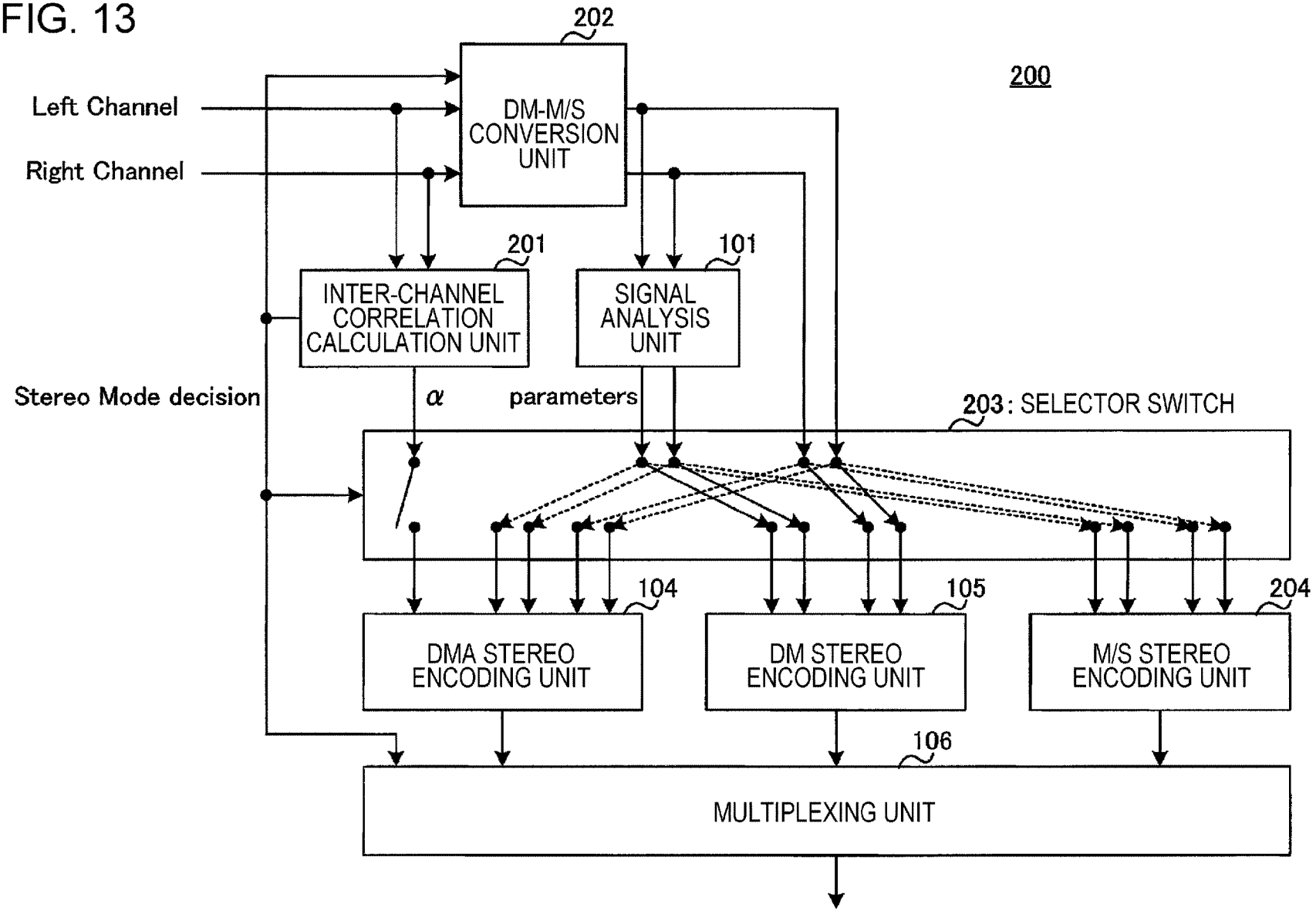
FIG. 13 is a block diagram illustrating a configuration example of an encoder according to a third embodiment.

FIG. 13 is a block diagram illustrating the configuration of an encoder 200 according to the present embodiment.

Note that the same reference numerals are used in FIG. 13 to describe those configurations that are identical to the configurations of the first embodiment (FIG. 5), and the description of the configurations are not repeated. More specifically, as compared with the configurations of the first embodiment (FIG. 5), the encoder 200 illustrated in FIG. 13 further includes a DM-M/S (Mid/Side) conversion unit 202 and an M/S stereo encoding unit 204.

In the encoder 200, an inter-channel correlation calculation unit 201 selects, from among DM stereo encoding, DMA stereo encoding, and added M/S stereo encoding, one of the stereo encoding modes on the basis of the calculated inter-channel correlation (the correlation coefficient α). The inter-channel correlation calculation unit 201 outputs a stereo mode decision flag indicating the selection result to the DM-M/S conversion unit 202, a selector switch 203, and the multiplexing unit 106.

For example, as illustrated in FIG. 14, the inter-channel correlation calculation unit 201 may determine that the DM stereo coding mode is to be selected if the correlation coefficient α is 0, may determine that the DMA stereo coding mode is to be selected if the correlation coefficient α is greater than 0 and less than or equal to 0.6, and may determine that the M/S stereo coding mode is to be selected if the correlation coefficient α is greater than 0.6.

That is, if the inter-channel correlation is high (α: High; in this example, $0.6<\alpha$), the M/S stereo coding is selected. If the inter-channel correlation is low (α=0), the DM stereo coding is selected. If the inter-channel correlation does not fall within any of the above ranges (α: Weak; in this example, $0<\alpha\leq 0.6$), the DMA stereo coding is selected.

Note that the ranges of the correlation coefficient α illustrated in FIG. 14 are only illustrative, and the ranges are not limited thereto.

If the stereo mode decision flag input from the inter-channel correlation calculation unit 201 indicates the M/S stereo encoding, the DM-M/S conversion unit 202 converts the L/R signal into an M/S signal as described below. Thereafter, the DM-M/S conversion unit 202 outputs the M/S signal to the signal analysis unit 101 and the selector switch 203. If the stereo mode decision flag indicates the DM stereo coding mode or the DMA stereo coding mode, the DM-M/S conversion unit 202 directly outputs the L/R signal to the signal analysis unit 101 and the selector switch 203.

If the stereo mode decision flag input from the inter-channel correlation calculation unit 201 indicates the M/S stereo coding mode, the selector switch 203 outputs the input L signal and R signal and the analysis parameters to the M/S stereo encoding unit 204 in addition to performing the operation of the first embodiment (the selector switch 103).

The M/S stereo encoding unit 204 performs M/S stereo encoding by using the L/R sum signal, the L/R difference signal, and the analysis parameters for each of the signals, which are input from the selector switch 203. When the M/S stereo coding is performed, the L signal and R signal of the stereo signal are converted into a Mid channel, which is the sum of the two channels, and a Side channel, which is the difference between the two channels in the DM-M/S conversion unit 202. For more information about the M/S stereo coding, the technique described in NPL 2 may be employed, for example.

If the inter-channel correlation is high, the M/S stereo coding is more efficient than the stereo coding. More specifically, if the inter-channel correlation is high, the side channel, which is the difference between the two channels, has a value close to zero. Consequently, the amount of encoded information can be reduced. However, if the inter-channel correlation is low, the amount of the encoded information can be reduced by the dual mono encoding, as compared with the M/S stereo encoding. In addition, if the inter-channel correlation is high, it is highly likely that the sound source is a single point sound source (e.g., the case where one person is speaking). In such a case, if L and R signals are generated by using a monauralized signal (the Mid channel signal) and the Side channel signal, a more stable stereo soundstage can be obtained.

In addition, as described above, in the M/S stereo coding, since the sum and the difference of the two channels are generated as coding information, decoding related units (not illustrated) decode a to-be-decoded signal on the basis of the coding information (the sum and difference) for each of the frames). That is, the sum of the Mid channel signal, which is the sum signal, and the Side channel signal, which is the difference signal, provides the R channel signal, and the difference between the sum signal (the Mid channel signal) and the difference signal (the Side channel signal) provides the L channel signal. That is, even when the coding modes of the Mid channel signal and the Side channel signal differ from each other, both the signals are reflected in each of the L channel and the R channel and, thus, it is not always necessary to apply the same coding mode. That is, if the M/S stereo coding is used, deterioration of the subjective quality of the decoded signal caused by different coding modes between channels can be prevented.

As described above, the encoder 200 switches between the dual mono encoding (DMA stereo encoding or DM stereo encoding) and the M/S stereo encoding in accordance with the inter-channel correlation (the correlation coefficient α). In this manner, the encoder 200 can select an appropriate coding mode and encode a stereo signal in accordance with the inter-channel correlation. As a result, the subjective quality of the decoded signal can be improved. Furthermore, the encoding information can be reduced.

Fourth Embodiment

According to the present embodiment, a method for efficiently obtaining the inter-channel correlation (the correlation coefficient α) is described.

The encoder according to the present embodiment has the same basic configuration as that of the encoder 100 according to the first embodiment. For this reason, the encoder is described below with reference to FIG. 5. However, according to the present embodiment, the encoder 100 includes an inter-channel correlation calculation unit 301 illustrated in FIG. 15 instead of the inter-channel correlation calculation unit 102 illustrated in FIG. 5.

The correlation coefficient α given by equation (1) described in the first embodiment is written as the following equation (9):

[Formula 9]

$$\alpha = \frac{\left|\sum_{k=1}^{Frame_{length}} l(k)R^*(k)\right|}{\left(\sqrt{\sum_{k=1}^{Frame_{Length}} l(k)l^*(k)}\right)\left(\sqrt{\sum_{k=1}^{Frame_{Length}} R(k)R^*(k)}\right)} = \frac{\text{Cross-Spectrum}}{\left(\sqrt{\text{Left Channel Energy}}\right)\left(\sqrt{\text{Right Channel Energy}}\right)}. \tag{9}$$

That is, as can be seen from equation (9), the correlation coefficient α is separated into a cross spectrum component (the numerator term "Cross-Spectrum") and left and right channel energy components ("Left Channel Energy" and "Right Channel Energy" in the denominator term).

According to the present embodiment, when the correlation coefficient α is calculated, instead of using all of the frequency spectrum parameters (the spectral coefficients) of the left channel and the right channel, the frequency spectrum parameters of some bands are used. In this manner, the amount of calculation of the cross correlation coefficient α is reduced.

Figure 15:
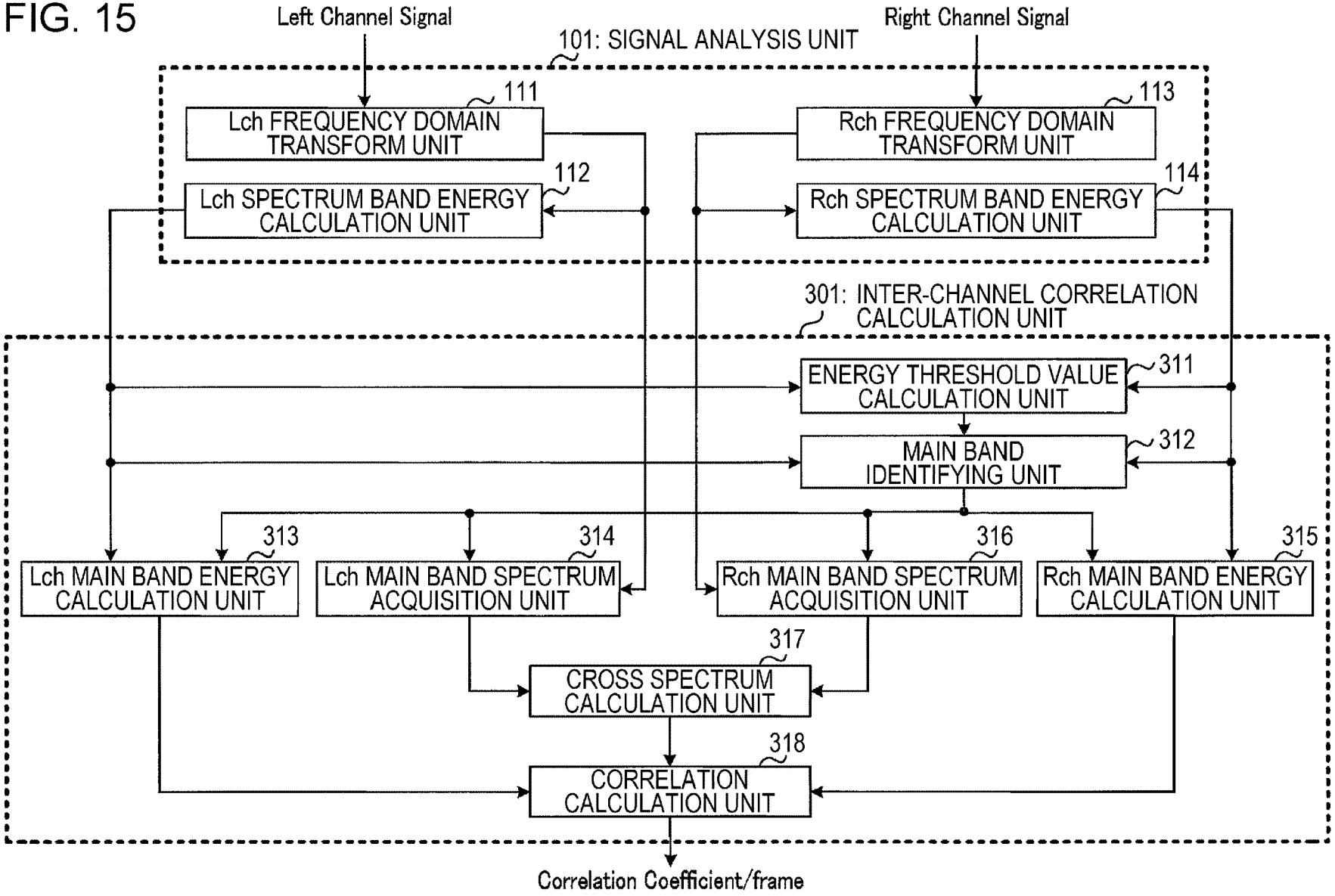
FIG. 15 is a block diagram illustrating a configuration example of a signal analysis unit and an inter-channel correlation calculation unit according to a fourth embodiment.

FIG. 15 is a block diagram illustrating a configuration example of a signal analysis unit 101 and the inter-channel correlation calculation unit 301 according to the present embodiment.

The signal analysis unit 101 employs a configuration including an Lch frequency domain transform unit 111, an Lch spectrum band energy calculation unit 112, an Rch frequency domain transform unit 113, and an Rch spectrum band energy calculation unit 114.

In addition, the inter-channel correlation calculation unit 301 employs a configuration including an energy threshold value calculation unit 311, a main band identifying unit 312, an Lch main band energy calculation unit 313, an Lch main band spectrum acquisition unit 314, an Rch main band energy calculation unit 315, an Rch main band spectrum acquisition unit 316, a cross spectrum calculation unit 317, and a correlation calculation unit 318.

In the signal analysis unit 101, the Lch frequency domain transform unit 111 performs frequency domain transform on the input L signal and outputs Lch frequency spectrum parameters to the Lch spectrum band energy calculation unit 112 and the Lch main band spectrum acquisition unit 314.

The Lch spectrum band energy calculation unit 112 groups the Lch frequency spectrum parameters input from the Lch frequency domain transform unit 111 into a plurality of spectrum bands and calculates the energy of each of the spectrum bands. The Lch spectrum band energy calculation unit 112 outputs the calculated Lch band energy values to the energy threshold value calculation unit 311, the main band identifying unit 312, and the Lch main band energy calculation unit 313.

The Rch frequency domain transform unit 113 performs frequency domain transform on the input R signal and outputs the Rch frequency spectrum parameters to the Rch spectrum band energy calculation unit 114 and the Rch main band spectrum acquisition unit 316.

The Rch spectrum band energy calculation unit 114 groups the Rch frequency spectrum parameters input from the Rch frequency domain transform unit 113 into a plurality of spectrum bands and calculates the energy of each of the spectrum bands. The Rch spectrum band energy calculation unit 114 outputs the calculated Rch band energy values to the energy threshold value calculation unit 311, the main band identifying unit 312, and the Rch main band energy calculation unit 315.

Note that it is assumed that the frequency domain transform and spectrum band energy calculation in the signal analysis unit 101 illustrated in FIG. 15 are performed in the codec which is a target of application of the inter-channel correlation calculation unit. In this case, the constituent elements of the signal analysis unit 101 illustrated in FIG. 15 do not have configurations additionally provided for the inter-channel correlation calculation according to the present embodiment. That is, the amount of processing performed by the signal analysis unit 101 does not increase.

Subsequently, in the inter-channel correlation calculation unit 301, the energy threshold value calculation unit 311 calculates an Lch energy threshold value and an Rch energy threshold value by using the Lch band energy values input from the Lch spectrum band energy calculation unit 112 and the Rch band energy values input from the Rch spectrum band energy calculation unit 114, respectively. The energy threshold value calculation unit 311 outputs the calculated Lch and Rch energy threshold values to the main band identifying unit 312.

The main band identifying unit 312 identifies, as the Lch main band, a spectrum band having an energy value that is one of the energy values input from the Lch spectrum band energy calculation unit 112 and that is greater than the Lch energy threshold value input from the energy threshold value calculation unit 311. Similarly, the main band identifying unit 312 identifies, as the Rch main band, a spectrum band having an energy value that is one of the energy values input from the Rch spectrum band energy calculation unit 114 and that is greater than the Rch energy threshold value input from the energy threshold value calculation unit 311. The main band identifying unit 312 outputs, as a "main band", the total sum of the identified Lch main band and R main band, that is, a band corresponding to either the Lch main band or the Rch main band to the Lch main band energy calculation unit 313, the Lch main band spectrum acquisition unit 314, the Rch main band energy calculation unit 315, and the Rch main band spectrum acquisition unit 316.

The Lch main band energy calculation unit 313 calculates the sum of the band energy values that are input from the Lch spectrum band energy calculation unit 112 and that correspond to the main band input from the Lch spectrum band energy calculation unit 312 and outputs, as the Lch main band energy, the sum to the correlation calculation unit 318.

The Lch main band spectrum acquisition unit 314 extracts the Lch frequency spectrum parameter corresponding to the main band input from the main band identifying unit 312 from the Lch frequency spectrum parameters input from the Lch frequency domain transform unit 111 and outputs, as the Lch main band spectrum, the Lch frequency spectrum parameter to the cross spectrum calculation unit 317.

The Rch main band energy calculation unit 315 calculates the sum of the band energy values that are input from the Rch spectrum band energy calculation unit 114 and that correspond to the main band input from the main band identifying unit 312 and outputs, as the Rch main band energy, the sum to the correlation calculation unit 318.

The Rch main band spectrum acquisition unit 316 extracts the Rch frequency spectrum parameter corresponding to the main band input from the main band identifying unit 312 from the Rch frequency spectrum parameters input from the Rch frequency domain transform unit 113 and outputs, as the Rch main band spectrum, the Rch frequency spectrum parameter to the cross spectrum calculation unit 317.

The cross spectrum calculation unit 317 uses the Lch main band spectrum input from the Lch main band spectrum acquisition unit 314 and the Rch main band spectrum input from the Rch main band spectrum acquisition unit 316 to calculate a cross spectrum (the numerator term of equation (9)). The cross spectrum calculation unit 317 outputs the calculated cross spectrum to the correlation calculation unit 318.

The correlation calculation unit 318 uses the Lch main band energy input from the Lch main band energy calculation unit 313 and the Rch main band energy input from the Rch main band energy calculation unit 315 to calculate the energy values of the left channel and the right channel (the denominator term of equation (9)). Thereafter, the correlation calculation unit 318 uses the calculated energy values (the denominator term of equation (9)) and the cross spectrum (the numerator term of equation (9)) input from the cross spectrum calculation unit 317 to calculate the inter-channel correlation (the cross correlation coefficient $\alpha$ in equation (9)).

Figure 16:
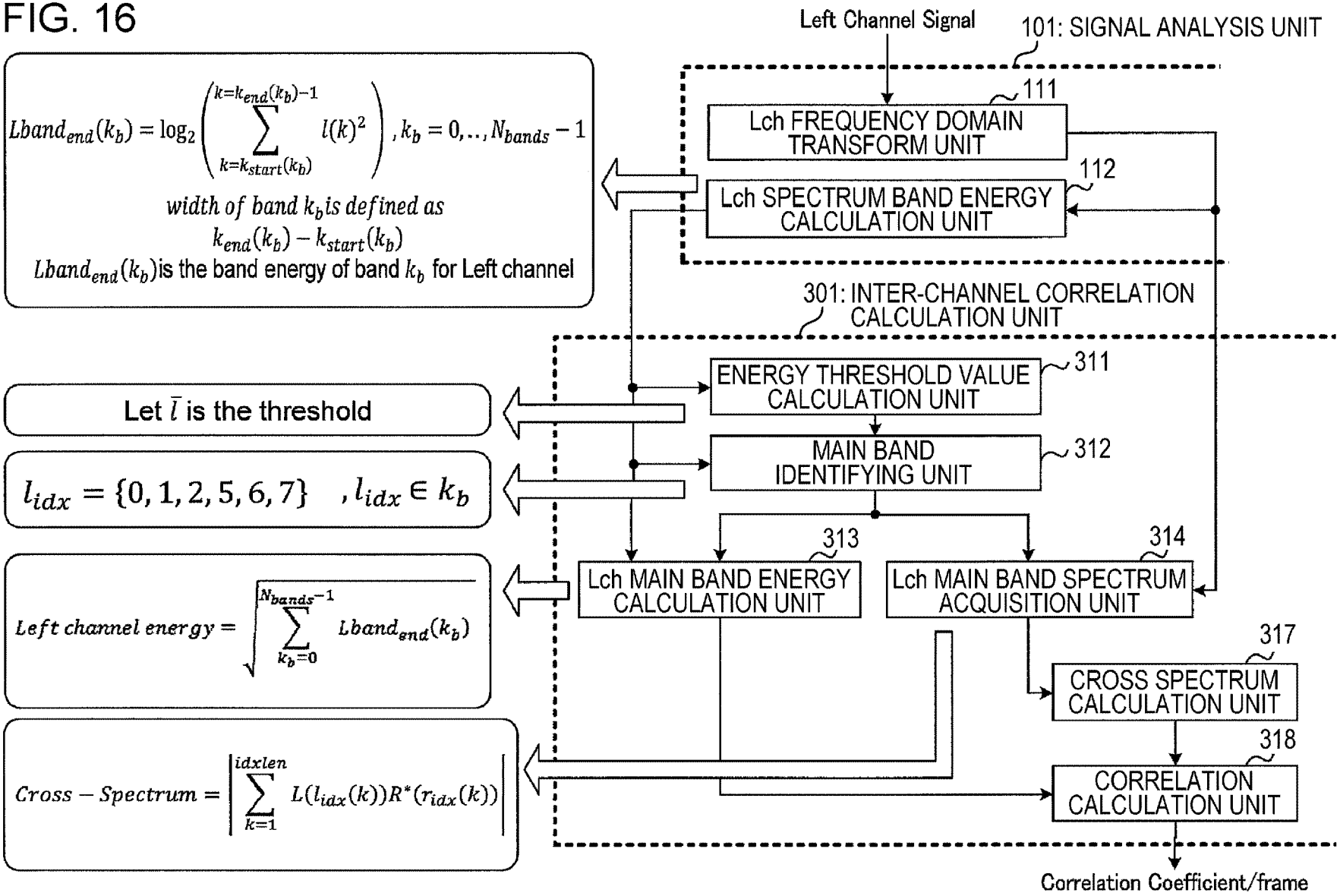
FIG. 16 is a diagram illustrating an operation example of a signal analysis unit and an inter-channel correlation calculation unit according to the fourth embodiment.

FIG. 16 illustrates an example of the processing related to the inter-channel correlation calculation process performed on the L signal by the signal analysis unit 101 and the inter-channel correlation calculation unit 301.

As illustrated in FIG. 16, the Lch spectrum band energy calculation unit 112 groups Lch frequency spectrum parameters I into $N_{bands}$ bands and calculates Lch band energy $Lband_{end}(k_b)$ of band $k_b$ ($k_b$=0 to ($N_{bands}$−1)).

The energy threshold value calculation unit 311 calculates an Lch energy threshold value $I^-$ by using the Lch band energy $Lband_{end}(k_b)$. For example, the energy threshold value calculation unit 311 may define the Lch energy threshold value $I^-$ by using the average value of the Lch band energy $Lband_{end}(k_b)$ or by using the average value and standard deviation of the Lch band energy $Lband_{end}(k_b)$ as described in NPL 1.

For example, when using an average $Avg_{ene}$ of band energy values and a standard deviation $\sigma_{bandene}$, an energy threshold value thr is given by the following equation (10):

[Formula 10]

$$thr = Avg_{ene} + \sigma_{band_{ene}} \tag{10}$$

The average $Avg_{ene}$ of band energy is given by the following equation (11):

[Formula 11]

$$Avg_{ene} = \frac{1}{N_{bands}} \sum_{k_b=0}^{N_{bands}-1} band_{ene}(k_b). \tag{11}$$

Subsequently, as the main band, the main band identifying unit 312 identifies, among the bands $k_b$ ($k_b$=0 to ($N_{bands}$−1)), a band having an Lch band energy $Lband_{end}(k_b)$ greater than the Lch energy threshold $I^-$. In FIG. 16, as an example, among the bands $k_b$ ($k_b$=0 to ($N_{bands}$−1)), the bands $K_b$=0, 1, 2, 5, 6, and 7 are identified as the main bands lick.

Subsequently, the Lch main band energy calculation unit 313 calculates the sum of the band energy values of the main bands $l_{idx}$ as Lch energy (Left channel energy). Since the Lch band energy $Lband_{end}(k_b)$ has already been calculated by the signal analysis unit 101, the main band energy calculation unit 313 may calculate the total energy of all the bands $k_b$ as Lch energy as illustrated in FIG. 16.

The Lch main band spectrum acquisition unit 314 acquires, among the Lch frequency spectrum parameters I, the Lch frequency spectrum parameter $L(I_{idx})$ included in the Lch main band $l_{idx}$.

The process for Lch has been described above. The process for the R signal in the signal analysis unit 101 and the inter-channel correlation calculation unit 301 can be performed in the same manner as in FIG. 16 (not illustrated). In this way, the Rch energy (Right channel energy) and the Rch frequency spectrum parameter $R(r_{idx})$ included in the Rch main band $r_{idx}$ are obtained for the R signal.

Thereafter, as illustrated in FIG. 16, the cross spectrum calculation unit 317 uses the Lch frequency spectrum parameter $L(l_{idx})$ of the Lch main band and the Rch frequency spectrum parameter $R(r_{idx})$ of the Rch main band to calculate a cross spectrum (Cross-Spectrum).

Note that idxlen represents the number of bands of the main band (in the example of FIG. 16, idxlen=6), and k represents the index of the spectrum band in the main band (in the example of FIG. 16, k=1 to 6 for $k_b$=0, 1, 2, 5, 6 and 7, respectively).

Finally, the correlation calculation unit 318 uses the Lch energy (Left channel energy), the Rch energy (Right channel energy), and the cross spectrum (Cross-Spectrum) to calculate the inter-channel correlation ($\alpha$) by using equation (9).

As described above, according to the present embodiment, when calculating the inter-channel correlation, the inter-channel correlation calculation unit 301 calculates the inter-channel correlation by using some of the spectrum bands. In addition, the inter-channel correlation calculation unit 301 uses, as some of the spectrum bands, the main bands having band energy greater than the energy threshold value. Thus, for example, as indicated by equation (12), the target of the cross spectrum calculation can be limited to the frequency spectrum parameters of the main bands. In this manner, according to the present embodiment, the amount of calculation can be reduced while maintaining the accuracy of inter-channel correlation.

[Modification 1 of Fourth Embodiment]

While the present embodiment has been described with reference to the main band identifying unit 312 that identifies the main band by using the band energy values of both Lch and Rch, a method for identifying the main band is not limited thereto. For example, the main band identifying unit 312 may select a dominant channel out of Lch and Rch and identify the main band of each of Lch and Rch by using the band energy of the selected dominant channel.

[Modification 2 of Fourth Embodiment]

The fourth embodiment has been described with reference to the inter-channel correlation calculation unit 301 that uses the frequency spectrum parameters included in the spectrum band (the main band) selected by the main band identifying unit 312 to obtain the inter-channel correlation. In contrast, according to the modification, the case where the inter-channel correlation is obtained by further selecting a main spectrum component is described.

Figure 17:
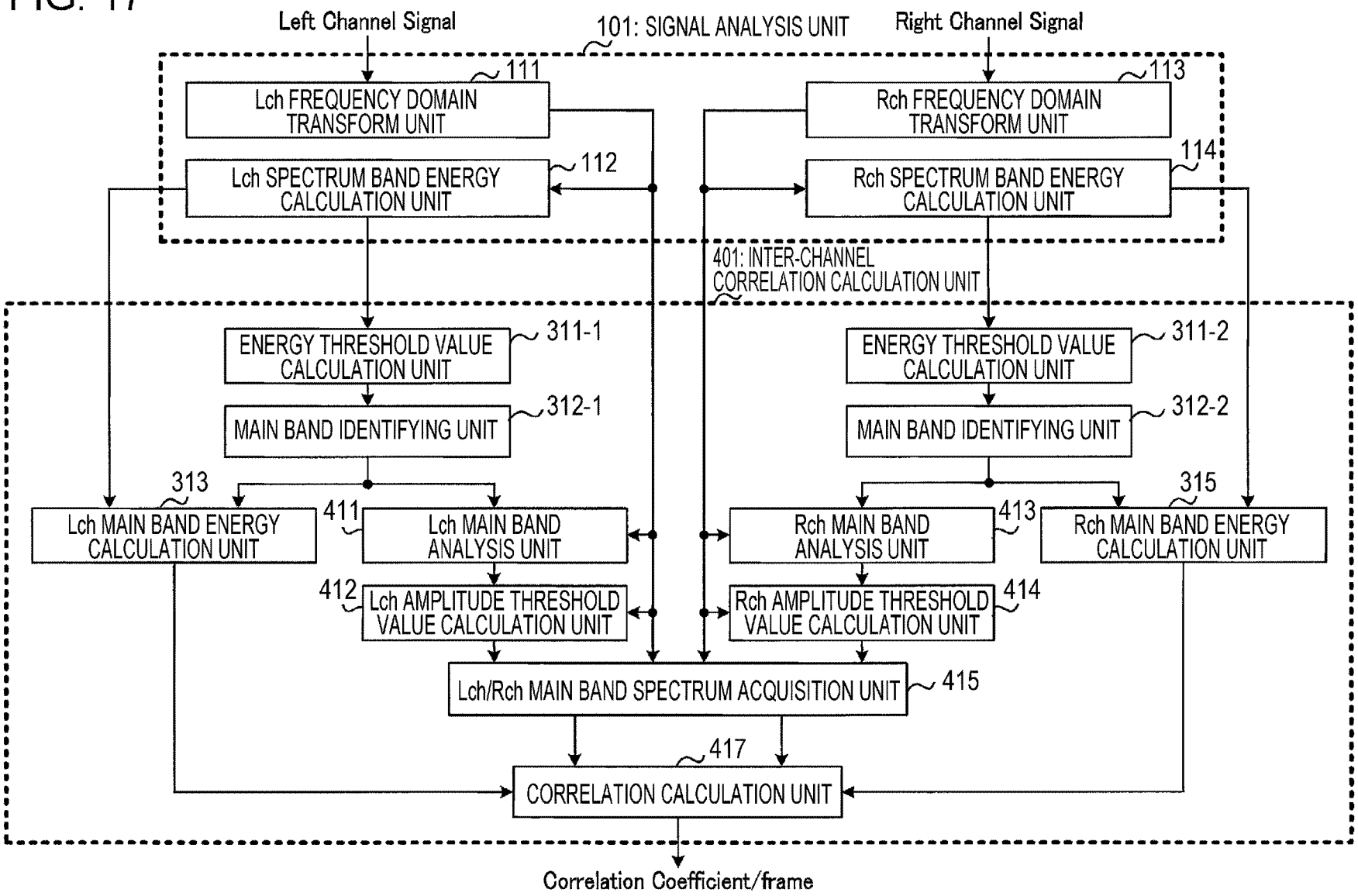
FIG. 17 is a block diagram illustrating a configuration example of a signal analysis unit and an inter-channel correlation calculation unit according to Modification 2 of the fourth embodiment.

FIG. 17 is a block diagram illustrating a configuration example of an inter-channel correlation calculation unit 401 according to Modification 2. Note that the same reference numerals are used in FIG. 17 to describe those configurations that are identical to the configurations in FIG. 15, and the description of the configurations are not repeated. In FIG. 17, an energy threshold value calculation unit 311 and a main band identifying unit 312 are provided for each of Lch and Rch.

In FIG. 17, an Lch main band analysis unit 411 calculates the amplitude (the energy) of the frequency spectrum parameter in the Lch main band input from a main band identifying unit 312-1 among the Lch frequency spectrum parameters input from the Lch frequency domain transform unit 111. The Lch main band analysis unit 411 outputs the amplitude to an Lch amplitude threshold value calculation unit 412.

The Lch amplitude threshold value calculation unit 412 calculates the average amplitude by using the amplitude values of the Lch frequency spectrum parameters in the spectrum band that is identified as the main band and that is input from the Lch main band analysis unit 411. The Lch amplitude threshold value calculation unit 412 outputs, as the Lch amplitude threshold value, the calculated average amplitude value to an Lch/Rch main band spectrum acquisition unit 415.

In addition, an Rch main band analysis unit 413 and an Rch amplitude threshold value calculation unit 414 perform, on the Rch, processing the same as the processing performed by the Lch main band analysis unit 411 and the Lch amplitude threshold value calculation unit 412.

The Lch/Rch main band spectrum acquisition unit 415 selects, from among the Lch frequency spectrum parameters input from the Lch frequency domain transform unit 111, one that is included in the main band and that has an amplitude (energy) greater than the Lch amplitude threshold value input from the Lch amplitude threshold value calculation unit 412. In addition, the Lch/Rch main band spectrum acquisition unit 415 selects, from among the Rch frequency spectrum parameters input from the Rch frequency domain transform unit 113, one that is included in the main band and that has an amplitude (energy) greater than the Rch amplitude threshold input from the Rch amplitude threshold value calculation unit 414. Thereafter, the Lch/Rch main band spectrum acquisition unit 415 selects a frequency component for which a frequency spectrum parameter of at least one of Lch and Rch is selected as a frequency component common to Lch and Rch used for correlation calculation. The Lch/Rch main band spectrum acquisition unit 415 outputs the Lch frequency spectrum parameter and the Rch frequency spectrum parameter of the selected frequency component to a correlation calculation unit 417.

The correlation calculation unit 417 uses the Lch frequency spectrum parameter and Rch frequency spectrum parameter input from Lch/Rch main band spectrum acquisition section 415 to calculate a cross spectrum (the numerator term of equation (9)). At this time, since the frequency spectrum parameters used for the calculation of the cross spectrum are limited to particularly high energy components in the Lch main band and the Rch main band, the amount of calculation is reduced, as compared with the case of using all of the frequency spectrum parameters in the Lch main band and the Rch main band.

In addition, like the correlation calculation unit 318, the correlation calculation unit 417 further calculates the denominator term of equation (9) and calculates the correlation coefficient $\alpha$ given by equation (9).

In this way, by further limiting the number of spectrum components included in the asserted band identified by the main band identifying unit 312, the amount of calculation of the cross spectrum can be further reduced.

Modifications 1 and 2 of the present embodiment have been described above.

It should be noted that the method for identifying the main band described in the present embodiment can be applied to various encoding methods for encoding the spectrum parameter. For example, by adapting to parametric stereo coding using the principle of BCC (Binaural Cue Coding) as described in NPL 3, it is possible to reduce the bit rate and the amount of computation. In parametric stereo coding, encoding is performed for each of the spectrum bands by using, as the side information, the parameters such as the inter-channel level difference (ICLD), inter-channel time difference (ICTD), and inter-channel coherence (ICC). At this time, if the ICLD, ICTD, ICC, and the like are calculated by using only the selected spectrum band or spectrum component by using the selection of the spectrum band and the selection of the spectrum component as described in the present embodiment, the amount of calculation required to calculate the side information can be reduced.

The embodiments of the present disclosure have been described above.

According to the above embodiments, when calculating the inter-channel energy difference Δ (for example, equation (2)), the long-term average of the channel energy may be used, instead of using the instantaneous value of the channel energy (the channel energy for the current frame), to stable the determination result of the dominant channel. For example, the encoder may determine the dominant channel or obtain the weighting coefficient by obtaining the inter-channel energy difference Δ in accordance with the following equation (12) and using the obtained inter-channel energy difference Δ:

[Formula 12]

$$\Delta = \overline{R}_{11} - \overline{R}_{22} \tag{12}$$

$$\overline{R}_{xx} = \frac{1}{N}\sum_{m=0}^{N-1} R_{xx}^{(frameno_{cur}-m)},\ x = 1, 2.$$

In this way, the encoder can make determination of a dominant channel or acquisition of a weighting coefficient with high accuracy.

In equation (12), N represents the number of frames subjected to long-term average calculation of channel energy, and $frameno_{cur}$ represents the current frame index. That is, ($frameno_{cur}$-m) represents a frame m frames before the current frame.

Moreover, the above-described embodiments may be combined and applied. For example, the encoder 200 according to the third embodiment (FIG. 13) may be provided with the DMA stereo encoding unit 150 (FIG. 11) according to the second embodiment instead of the DMA stereo encoding unit 104. Alternatively, the encoder 200 according to the third embodiment (FIG. 13) may be provided with the inter-channel correlation calculation unit 301 (FIG. 15) or the inter-channel correlation calculation unit 401 (FIG. 17) according to the fourth embodiment instead of the inter-channel correlation calculation unit 102.

Moreover, while the above embodiments have been described with reference to the case where ACELP, TCX, HQ MDCT, GSC, or the like is used as an example of the coding mode, the coding mode is not limited thereto.

Note that the present disclosure can be implemented by software, hardware, or software in cooperation with hardware. Each of the functional blocks used in the description of the above embodiments is partially or entirely implemented in the form of an LSI, which is an integrated circuit, and each of the processes described in the above embodiment may be partially or entirely controlled by a single LSI or a combination of LSIs. The LSI may be configured from individual chips or may be configured from a single chip so as to include some or all of the functional blocks. The LSI may have a data input and a data output. The LSI is also referred to as an "IC", a "system LSI", a "super LSI" or an "ultra LSI" in accordance with the level of integration. In addition, the method for circuit integration is not limited to LSI, and the circuit integration may be achieved by dedicated circuitry, a general-purpose processor, or a dedicated processor. Alternatively, an FPGA (Field Programmable Gate Array), which is programmable after fabrication of the LSI, or a reconfigurable processor which allows reconfiguration of connections and settings of circuit cells in LSI may be used. The present disclosure may be implemented as digital processing or analog processing. Moreover, should a circuit integration technology replacing LSI appear as a result of advancements in semiconductor technology or other technologies derived from the technology, the functional blocks could be integrated using such a technology. Another possibility is the application of biotechnology, for example.

According to the present disclosure, an encoder includes a calculation circuit that calculates an inter-channel correlation between a left channel and a right channel by using a left channel signal and a right channel signal that constitute a stereo signal and an encoding circuit that encodes the left channel signal and the right channel signal by using a common coding mode if the inter-channel correlation is greater than a threshold value and individually encodes the left channel signal and the right channel signal by using a coding mode determined for each of the left channel signal and the right channel signal if the inter-channel correlation is less than or equal to the threshold value.

In the encoder according to the present disclosure, the encoding circuit identifies a dominant channel and a non-dominant channel for the left channel and the right channel, calculates a weighted sum of a first parameter for determining the coding mode of the dominant channel and a second parameter for determining the coding mode of the non-dominant channel, and selects the common coding mode on the basis of the weighted parameter obtained through the weighted sum.

In the encoder according to the present disclosure, a first weighting coefficient for the first parameter is greater than a second weighting coefficient for the second parameter, and the first weighting coefficient increases with decreasing inter-channel correlation.

In the encoder according to the present disclosure, the first weighting coefficient for the first parameter is greater than the second weighting coefficient of the second parameter, and the first weighting coefficient increases with increasing energy difference between the left channel signal and the right channel signal.

In the encoder according to the present disclosure, the encoding circuit reselects the common coding mode for a current frame if the common coding mode selected for the current frame differs from the common coding mode selected for a previous frame and a coding mode determined on the basis of the first parameter for the current frame and is the same as any one of the coding modes determined on the basis of the second parameter of the current frame.

In the encoder according to the present disclosure, the encoding circuit performs a smoothing process by using the weighted parameter of the current frame and the weighted parameter of a previous frame and reselects the common coding mode on the basis of the weighted parameter obtained after the smoothing process.

In the encoder according to the present disclosure, the encoding circuit further performs Mid/Side stereo encoding on the left channel signal and the right channel signal if the inter-channel correlation is greater than a second threshold value that is greater than the threshold value.

In the encoder according to the present disclosure, the calculation circuit calculates the inter-channel correlation by using frequency spectrum parameters of some of bands of the left channel signal and the right channel signal.

According to the present disclosure, an encoding method includes calculating an inter-channel correlation between a left channel and a right channel by using a left channel signal and a right channel signal that constitute a stereo signal and encoding the left channel signal and the right channel signal by using a common coding mode if the inter-channel correlation is greater than a threshold value and individually encodes the left channel signal and the right channel signal by using a coding mode determined for each of the left channel signal and the right channel signal if the inter-channel correlation is less than or equal to the threshold value.

INDUSTRIAL APPLICABILITY

An aspect of the present disclosure is useful for a voice communication system using a multi-mode encoding technique.

REFERENCE SIGNS LIST

100, 200 encoder
101 signal analysis unit
102, 201, 301, 401 inter-channel correlation calculation unit
103, 203 selector switch
104, 150 DMA stereo encoding unit
105 DM stereo encoding unit
106 multiplexing unit
141 adaptive mixing unit
142 coding mode selection unit
143 Lch encoding unit
144 Rch encoding unit
145 bit stream generation unit
151 determination correction unit
202 DM-M/S conversion unit
204 M/S stereo encoding unit
311 energy threshold value calculation unit
312 main band identifying unit
313 Lch main band energy calculation unit
314 Lch main band spectrum acquisition unit
315 Rch main band energy calculation unit
316 Rch main band spectrum acquisition unit
317 cross spectrum calculation unit
318, 417 correlation calculation unit
411 Lch main band analysis unit
412 Lch amplitude threshold value calculation unit
413 Rch main band analysis unit
414 Rch amplitude threshold value calculation unit
415 Lch/Rch main band spectrum acquisition unit

The invention claimed is:

1. An encoder comprising:

a calculation circuit that calculates an inter-channel correlation between a left channel and a right channel by using a left channel signal and a right channel signal that constitute a stereo signal; and an encoding circuit that encodes the left channel signal and the right channel signal by using a common coding mode when the inter-channel correlation is greater than a threshold value, and individually encodes the left channel signal and the right channel signal by using a coding mode determined for each of the left channel signal and the right channel signal when the inter-channel correlation is less than or equal to the threshold value, wherein the encoding circuit identifies a dominant channel and a non-dominant channel for the left channel and the right channel, calculates a weighted sum of a first parameter for determining the coding mode of the dominant channel and a second parameter for determining the coding mode of the non-dominant channel, and selects the common coding mode on the basis of a weighted parameter obtained through the weighted sum calculation.

2. The encoder according to claim 1, wherein a first weighting coefficient for the first parameter is greater than a second weighting coefficient for the second parameter, and wherein the first weighting coefficient increases with decreasing inter-channel correlation.

3. The encoder according to claim 1, wherein a first weighting coefficient for the first parameter is greater than a second weighting coefficient of the second parameter, and wherein the first weighting coefficient increases with increasing energy difference between the left channel signal and the right channel signal.

4. The encoder according to claim 1, wherein the encoding circuit reselects the common coding mode for a current frame when the common coding mode selected for the current frame differs from the common coding mode selected for a previous frame and a coding mode determined on the basis of the first parameter for the current frame, and is the same as any one of the coding modes determined on the basis of the second parameter of the current frame.

5. The encoder according to claim 4, wherein the encoding circuit performs a smoothing process by using the weighted parameter of the current frame and the weighted parameter of a previous frame, and reselects the common coding mode on the basis of a weighted parameter obtained after the smoothing process.

6. The encoder according to claim 1, wherein the encoding circuit further performs Mid/Side stereo encoding on the left channel signal and the right channel signal when the inter-channel correlation is greater than a second threshold value that is greater than the threshold value.

7. The encoder according to claim 1, wherein the calculation circuit calculates the inter-channel correlation by using frequency spectrum parameters of some of bands of the left channel signal and the right channel signal.

8. An encoding method, comprising:

calculating an inter-channel correlation between a left channel and a right channel by using a left channel signal and a right channel signal that constitute a stereo signal; and encoding the left channel signal and the right channel signal by using a common coding mode when the inter-channel correlation is greater than a threshold value, and individually encodes the left channel signal and the right channel signal by using a coding mode determined for each of the left channel signal and the right channel signal when the inter-channel correlation is less than or equal to the threshold value, wherein in the encoding, a dominant channel and a non-dominant channel are identified for the left channel and the right channel, wherein a weighted sum of a first parameter for determining the coding mode of the dominant channel and a second parameter for determining the coding mode of the non-dominant channel are calculated, and wherein the common coding mode is selected on the basis of a weighted parameter obtained through the weighted sum calculation.

9. The encoding method according to claim 8, wherein a first weighting coefficient for the first parameter is greater than a second weighting coefficient for the second parameter, and wherein the first weighting coefficient increases with decreasing inter-channel correlation.

10. The encoding method according to claim 8, wherein a first weighting coefficient for the first parameter is greater than a second weighting coefficient of the second parameter, and wherein the first weighting coefficient increases with increasing energy difference between the left channel signal and the right channel signal.

11. The encoding method according to claim 8, wherein in the encoding, the common coding mode for a current frame is reselected when the common coding mode selected for the current frame differs from the common coding mode selected for a previous frame and a coding mode determined on the basis of the first parameter for the current frame and is the same as any one of the coding modes determined on the basis of the second parameter of the current frame.

12. The encoding method according to claim 11, wherein in the encoding, a smoothing process is performed by using the weighted parameter of the current frame and the weighted parameter of a previous frame, and the common coding mode is reselected on the basis of the weighted parameter obtained after the smoothing process.

13. The encoding method according to claim 8, wherein in the encoding, Mid/Side stereo encoding is performed on the left channel signal and the right channel signal when the inter-channel correlation is greater than a second threshold value that is greater than the threshold value.

14. The encoding method according to claim 8, wherein in the calculating an inter-channel correlation, the inter-channel correlation is calculated by using frequency spectrum parameters of some of bands of the left channel signal and the right channel signal.

* * * * *